US010525519B2

(12) United States Patent
Carstens et al.

(10) Patent No.: US 10,525,519 B2
(45) **Date of Patent: *Jan. 7, 2020**

(54) CONTAINER, AND SELECTIVELY FORMED CUP, TOOLING AND ASSOCIATED METHOD FOR PROVIDING SAME

(71) Applicant: Stolle Machinery Company, LLC, Centennial, CO (US)

(72) Inventors: Aaron E. Carstens, Centerville, OH (US); James A. McClung, Canton, OH (US); Paul L. Ripple, Canton, OH (US); Gregory H. Butcher, Naples, FL (US)

(73) Assignee: Stolle Machinery Company, LLC, Centennial, CO (US)

( * ) Notice: Subject to any disclaimer, the term of this patent is extended or adjusted under 35 U.S.C. 154(b) by 590 days.

This patent is subject to a terminal disclaimer.

(21) Appl. No.: 15/286,954

(22) Filed: Oct. 6, 2016

(65) Prior Publication Data

US 2017/0095852 A1 Apr. 6, 2017

Related U.S. Application Data

(60) Continuation-in-part of application No. 13/856,694, filed on Apr. 4, 2013, now Pat. No. 9,481,022, which (Continued)

(51) Int. Cl.
*B21D 22/20* (2006.01)
*B21D 24/00* (2006.01)

(52) U.S. Cl.
CPC ..... *B21D 22/20* (2013.01); *B21D 24/005* (2013.01)

(58) Field of Classification Search
CPC ..... B21D 22/20; B21D 22/22; B21D 24/005; B21D 51/26
See application file for complete search history.

(56) References Cited

U.S. PATENT DOCUMENTS 2,075,847 A 4/1937 Hothersall
3,409,167 A 11/1968 Blanchard
(Continued)

FOREIGN PATENT DOCUMENTS

CN 2013167634 9/2009
EP 0237161 9/1987
(Continued)

OTHER PUBLICATIONS

Japanese Unexamined Patent Publication 2003-53438, Machine translation, 8 pgs.
(Continued)

*Primary Examiner* — Teresa M Ekiert
(74) *Attorney, Agent, or Firm* — Eckert Seamans Cherin & Mellot, LLC

(57) ABSTRACT

A container, such as a beverage or food can is provided, which includes a first sidewall, a second sidewall and a bottom portion extending between the first and second sidewalls. The material of the bottom portion is stretched relative to the first sidewall and the second sidewall to form a thinned preselected profile, such as a dome. The material of the container at or about the dome has a substantially uniform thickness. The container is formed from a blank of material, which has a base gauge prior to being formed. After being formed, the blank of material of the container at or about the dome has a thickness less than the base gauge. Tooling having a clamp bead, or a progressive clamp bead, for selectively forming a blank of material into a container, as well as an associated method are also disclosed.

16 Claims, 19 Drawing Sheets

Related U.S. Application Data is a division of application No. 12/902,202, filed on Oct. 12, 2010, now Pat. No. 8,439,222.

(60) Provisional application No. 61/253,633, filed on Oct. 21, 2009.

(56) References Cited

U.S. PATENT DOCUMENTS

| | | | | |
|---|---|---|---|---|
| 3,979,009 | A | 9/1976 | Walker | |
| 4,020,670 | A | 5/1977 | Bulso, Jr. et al. | |
| 4,214,471 | A | 7/1980 | Bulso, Jr. et al. | |
| 4,248,076 | A | 2/1981 | Bulso, Jr. et al. | |
| 4,341,321 | A | 7/1982 | Gombas | |
| 4,343,173 | A | 8/1982 | Bulso, Jr. et al. | |
| 4,372,143 | A | 2/1983 | Elert et al. | |
| 4,416,140 | A | 11/1983 | Bulso, Jr. et al. | |
| 4,454,743 | A | 6/1984 | Bulso, Jr. et al. | |
| 4,483,172 | A | 11/1984 | Bulso, Jr. et al. | |
| 4,485,663 | A * | 12/1984 | Gold | B21D 22/22 72/347 |
| 4,503,702 | A | 3/1985 | Bulso et al. | |
| 4,535,618 | A | 8/1985 | Bulso, Jr. et al. | |
| 4,685,322 | A | 8/1987 | Clowes | |
| 4,696,177 | A | 9/1987 | Bulso, Jr. et al. | |
| 4,723,433 | A | 2/1988 | Grims | |
| 4,732,031 | A | 3/1988 | Bulso, Jr. et al. | |
| 4,800,743 | A | 1/1989 | Bulso, Jr. et al. | |
| 4,826,382 | A | 5/1989 | Bulso, Jr. et al. | |
| 5,024,077 | A | 6/1991 | Bulso, Jr. et al. | |
| 5,081,859 | A | 1/1992 | De Smet | |
| 5,154,075 | A | 10/1992 | Hahn et al. | |
| 5,218,849 | A | 6/1993 | Sieger et al. | |
| 5,394,727 | A | 3/1995 | Diekhoff et al. | |
| 5,598,734 | A | 2/1997 | Forrest et al. | |
| 5,622,070 | A | 4/1997 | Bulso, Jr. | |
| 5,881,593 | A | 3/1999 | Bulso, Jr. et al. | |
| 6,070,447 | A | 6/2000 | Bone et al. | |
| 7,124,613 | B1 | 10/2006 | McClung | |
| 9,481,022 | B2 * | 11/2016 | McClung | B21D 22/20 |
| 9,545,655 | B2 | 1/2017 | Riley et al. | |
| 2003/0140672 | A1 | 7/2003 | Gruszka et al. | |
| 2006/0191310 | A1 | 8/2006 | Turnbull et al. | |
| 2009/0026214 | A1 | 1/2009 | Yuan et al. | |
| 2011/0089182 | A1 | 4/2011 | McClung et al. | |
| 2012/0305557 | A1 | 12/2012 | Riley et al. | |
| 2013/0037555 | A1 | 2/2013 | Monro | |
| 2013/0239644 | A1 | 9/2013 | McClung et al. | |
| 2015/0251237 | A1 | 9/2015 | McClung et al. | |

FOREIGN PATENT DOCUMENTS

| | | |
|---|---|---|
| JP | 54-61069 | 5/1979 |
| JP | 62-230439 | 9/1987 |
| JP | 04-118121 | 4/1992 |
| JP | 07-144239 | 6/1995 |
| JP | 07-232230 | 9/1995 |
| JP | 2003-530220 | 10/2003 |
| JP | 2004-314084 | 11/2004 |
| JP | 2013508167 | 3/2013 |

OTHER PUBLICATIONS

English translation of Decision of Rejection, Japanese Patent Office, dated Apr. 14, 2015, 3 pgs.

English translation of Chinese Search Report/Office Action for 201080046932.X, dated Jan. 6, 2014, 9 pgs.

English translation of Japanese Office Action for JP Application No. 2012-535231, dated Aug. 19, 2014, 5 pgs.

Stolle Machinery Company, LLC, PCT/US17/49320 International Search Report, dated Jan. 4, 2018, 15 pages.

* cited by examiner

FORMING STAGES
(WITH STEP BEAD)

FORMING STAGES
(WITHOUT STEPS BEAD)

400A
402A
404A 519
600
517
406A
408A
515
520
562
A
521
554
B
560
550
552
500
502

510
504
512
530
514
516
570

CONTAINER, AND SELECTIVELY FORMED CUP, TOOLING AND ASSOCIATED METHOD FOR PROVIDING SAME

CROSS-REFERENCE TO RELATED APPLICATIONS

This application is a continuation-in-part application of U.S. patent application Ser. No. 13/856,694, filed Apr. 4, 2013, entitled "CONTAINER, AND SELECTIVELY FORMED CUP, TOOLING AND ASSOCIATED METHOD FOR PROVIDING SAME," which application is a divisional application of U.S. patent application Ser. No. 12/902,202, filed Oct. 12, 2010, (U.S. Pat. No. 8,439,222, issued May 14, 2013) entitled "CONTAINER, AND SELECTIVELY FORMED CUP, TOOLING AND ASSOCIATED METHOD FOR PROVIDING SAME," which application claims the benefit of U.S. Provisional Application Ser. No. 61/253,633, filed on Oct. 21, 2009, entitled "CONTAINER, AND SELECTIVELY FORMED CUP, TOOLING AND ASSOCIATED METHOD FOR PROVIDING SAME."

BACKGROUND

Field

The disclosed concept relates generally to containers and, more particularly, to metal containers such as, for example, beer or beverage cans, as well as food cans. The disclosed concept also relates to cups and blanks for forming cups and containers. The disclosed concept further relates to methods and tooling for selectively forming a cup or bottom portion of a container to reduce the amount of material in the cup or bottom portion and to reduce the force required to form the material as well as the counter forced acting on the tooling.

Background Information

It is generally well known to draw and iron a sheet metal blank to make a thin walled container or can body for packaging beverages (e.g., carbonated beverages; non-carbonated beverages), food or other substances. Typically, one of the initial steps in forming such containers is to form a cup. The cup is generally shorter and wider than the finished container. Accordingly, the cups are typically subjected to a variety of additional processes that further form the cup into the finished container. As shown, for example, in FIG. 1, a conventional can body 2 has thinned first and second sidewalls 4, 6 and a bottom profile 8, which includes an outwardly protruding annular ridge 10. It is understood that in the cross-sectional view the opposing first and second sidewalls 4, 6 are portions of a contiguous sidewall (which hereinafter may be identified by a single reference number, e.g., reference "4"). The bottom profile 8 slopes inwardly from the annular ridge 10 to form an inwardly projecting dome portion 12. The can body 2 is formed from a blank of material 14 (e.g., without limitation, sheet metal).

There is a constant desire in the industry to reduce the gauge, and thus the amount of material used to form such containers. However, among other disadvantages associated with the formation of containers from relatively thin gauge material, is the tendency of the container to wrinkle, particularly during redrawing and doming. Prior proposals have, in large part, focused on forming bottom profiles of various shapes that were intended to be strong and, therefore, capable of resisting buckling while enabling metal having a thinner base gauge to be used to make the can body. Thus, the conventional desire has been to maintain the material thickness in the dome and bottom profile to maintain or increase strength in this area of the can body and thereby avoid wrinkling.

Tooling for forming domed cups or can bodies has conventionally included a curved, convex punch core and a concave die core, such that a domed can body is formed from material (e.g., without limitation, a sheet metal blank) conveyed between the punch core and the die core. Typically, the punch core extends downwardly into the die core, forming the domed cup or can body. In order to maintain the thickness of the domed portion, the material is relatively lightly clamped on either side of the portion to be domed. That is, the material can move (e.g., slide) or flow toward the dome as it is formed in order to maintain the desired thickness in the bottom profile. Doming methods and apparatus are disclosed, for example and without limitation, in U.S. Pat. Nos. 4,685,322; 4,723,433; 5,024,077; 5,154,075; 5,394,727; 5,881,593; 6,070,447; and 7,124,613, which are hereby incorporated herein by reference.

There is, therefore, room for improvement in containers such as beer/beverage cans and food cans, as well as in selectively formed cups and tooling and methods for providing such cups and containers.

SUMMARY

These needs and others are met by embodiments of the disclosed concept which provide metal containers, such as beverage and food cans, cups and blanks for forming cups and containers, and methods and tooling for selectively forming a cup or bottom portion of a container to reduce the amount of material in the cup or bottom portion.

As one aspect of the disclosed concept, a container comprises: a first sidewall, a second sidewall, and a bottom portion extending between the first sidewall and the second sidewall. The material of the bottom portion is stretched relative to the first sidewall and the second sidewall to form a thinned preselected profile.

The thinned preselected profile may be a dome. The material of the container at or about the dome may have a substantially uniform thickness. The container may be formed from a blank of material, wherein the blank of material has a base gauge prior to being formed. After being formed, the material of the container at or about the dome may have a thickness less than the base gauge. The thickness of the material at or about the dome may be about 0.0003 inch to about 0.003 inch thinner than the base gauge. That is, there is about 10% maximum thinning of aluminum material, or 25% maximum thinning for steel, at the dome.

The container may be formed from a blank of material, wherein the blank of material has a preformed dome portion.

As another aspect of the disclosed concept, tooling is provided for selectively forming a blank of material into a container. The container includes a first sidewall, a second sidewall, and a bottom portion extending between the first sidewall and the second sidewall. The tooling comprises: an upper tooling assembly and a lower tooling assembly. The blank of material is clamped between the upper tooling assembly and the lower tooling assembly, proximate to the first sidewall and proximate to the second sidewall. The bottom portion is stretched relative to the first sidewall and the second sidewall to form a thinned preselected profile.

As a further aspect of the disclosed concept, a method for selectively forming a container is provided. The method comprises: introducing a blank of material to tooling; forming the blank of material to include a first sidewall, a second sidewall and a bottom portion extending between the first sidewall and the second sidewall; clamping the material between the tooling proximate to the first sidewall and proximate to the second sidewall to resist movement of the material; and stretching the bottom portion to form a thinned preselected profile.

As a further aspect of the disclosed concept, tooling, including a clamp bead, is provided for selectively forming a blank of material into a container. Generally, a "bead" is a resulting formation on the can body 2. In one exemplary embodiment, the clamping of the material between the tooling proximate to the first sidewall and proximate to the second sidewall to resist movement of the material utilizes a contoured step bead. As employed herein, a "step bead" in relation to tooling, means elements of the tooling are structured to form a "step bead." As employed herein, a "step bead" in relation to a can body, means a bead, i.e., an elongated projection, extending about, i.e., encircling, an inner area, wherein one perimeter of the bead is at one elevation and the opposing perimeter of the bead is at another elevation, where the "elevation" is relative to the inner area about which the "step bead" extends. It is noted that the step bead facilitates holding the material substantially stationary, for example, by crimping it and locking the material just inboard of the cup sidewall, as described below. Similarly, as employed herein, a "non-step bead" is a bead extending about an inner area, wherein both perimeters of the bead are at one elevation which is generally aligned with the inner area about which the "non-step bead" extends.

Further as employed herein, the term(s) "clamp bead" when used in relation to tooling, means elements of the tooling are structured to form a "clamp bead." It is understood that a tooling "clamp bead" includes a protrusion on one tooling assembly and a recess on an opposed tooling assembly. As employed herein, a "clamp bead" means a non-step bead wherein the upper tool assembly and the lower tool assembly clamp (see definition below) the material being formed. That is, material does not substantially move (e.g., slide) or flow in at least one direction past or through the "clamp bead," as discussed below. Further, as employed herein, in reference to material or a container, a "clamp bead" remains a "clamp bead" after the forming process is complete. That is, as used herein, the bead on a container that was formed as a "clamp bead" remains a "clamp bead" after the forming process is complete. Further, it is understood that containers, and therefore the tooling that made those containers, included common "beads." Tooling for such beads allowed material to flow through the bead. Such beads, and the tooling used to form such beads, are not a "clamp beads" as used herein. That is, unless a bead is specifically described as, and/or is shown to be, a "clamp bead," as defined above, then a bead is just a bead. Similarly, unless the tooling that created such beads are specifically described as, and/or are shown to be, structured to form a "clamp bead," then, as used herein, such tooling only forms a common bead.

Similarly as employed herein, the term(s) "progressive clamp bead" when used in relation to tooling, means elements of the tooling are structured to form a "progressive clamp bead" on a material being formed. As employed herein, a "progressive clamp bead" when used in relation to a material being formed means a non-step bead formed by an upper tool assembly and a lower tool assembly that progressively clamp (see definition below) the material being formed. That is, material is maintained in a substantially fixed position while initially allowing material to move (e.g., slide) or flow in at least one direction through the "progressively clamped" area. As the force of the engagement increases, the amount of material that moves/flows through the "progressively clamped" area decreases until the amount is negligible.

Further, as employed herein, in reference to a container, a "progressive clamp bead" remains a "progressive clamp bead" after the forming process is complete. Further, it is understood that containers, and therefore the tooling that made those containers, included beads. Tooling for such beads allowed material to consistently flow through the bead. Such beads are not a "progressive clamp bead." That is, unless a bead is specifically described as, and/or is shown to be, a "progressive clamp bead," as defined above, then a bead is just a bead. Similarly, unless the tooling that created such beads are specifically described as, and/or are shown to be, structured to form a "progressive clamp bead," then, as used herein, such tooling only forms a common bead.

Selectively thinning a predetermined portion of the shell or cup relative to at least one other portion of the shell or cup to provide a corresponding thinned portion of the shell has been determined to create certain complications such as an overloading condition on the tooling and/or press. Further, the selective thinning may result in excessively uneven thinning. That is, while some unevenness in the thinning is acceptable, excessive uneven thinning is not desirable. It is desirable that the selective thinning be accomplished with existing presses. There is, therefore, room for improvement in the tooling.

These needs and others are met by the disclosed concept, which is directed to a tooling including a reduced force forming surface and/or a hybrid bias generating assembly. In an exemplary embodiment, the hybrid bias generating assembly is one of an active hybrid bias generating assembly or a selectable hybrid bias generating assembly, as defined below. It is understood that, in the known art, to increase the pressure acting on a cup (or shell), manufacturers simply increased the pressure acting on the tooling. This increase in pressure created a counter load that was applied to the press. As disclosed herein, concentrating the force/pressure on a forming surface allows for reduced counter loads to be applied to the press. Further, use of a clamp bead or a progressive clamp bead also allows for reduced forces and counter loads to be applied to the press and solves the problems stated above. Further, reduced forces and counter loads, as stated below, allows for the use of existing presses and solves the problems stated above. Further, the use of a hybrid bias generating assembly prevents an excessive amount of uneven thinning and therefore solves the stated problem.

It is further noted that the reduction in the load required to form a shell or cup allows for additional pockets on a tooling thereby increasing the efficiency of the associated press and solves the problems stated above.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figures 1, 2:
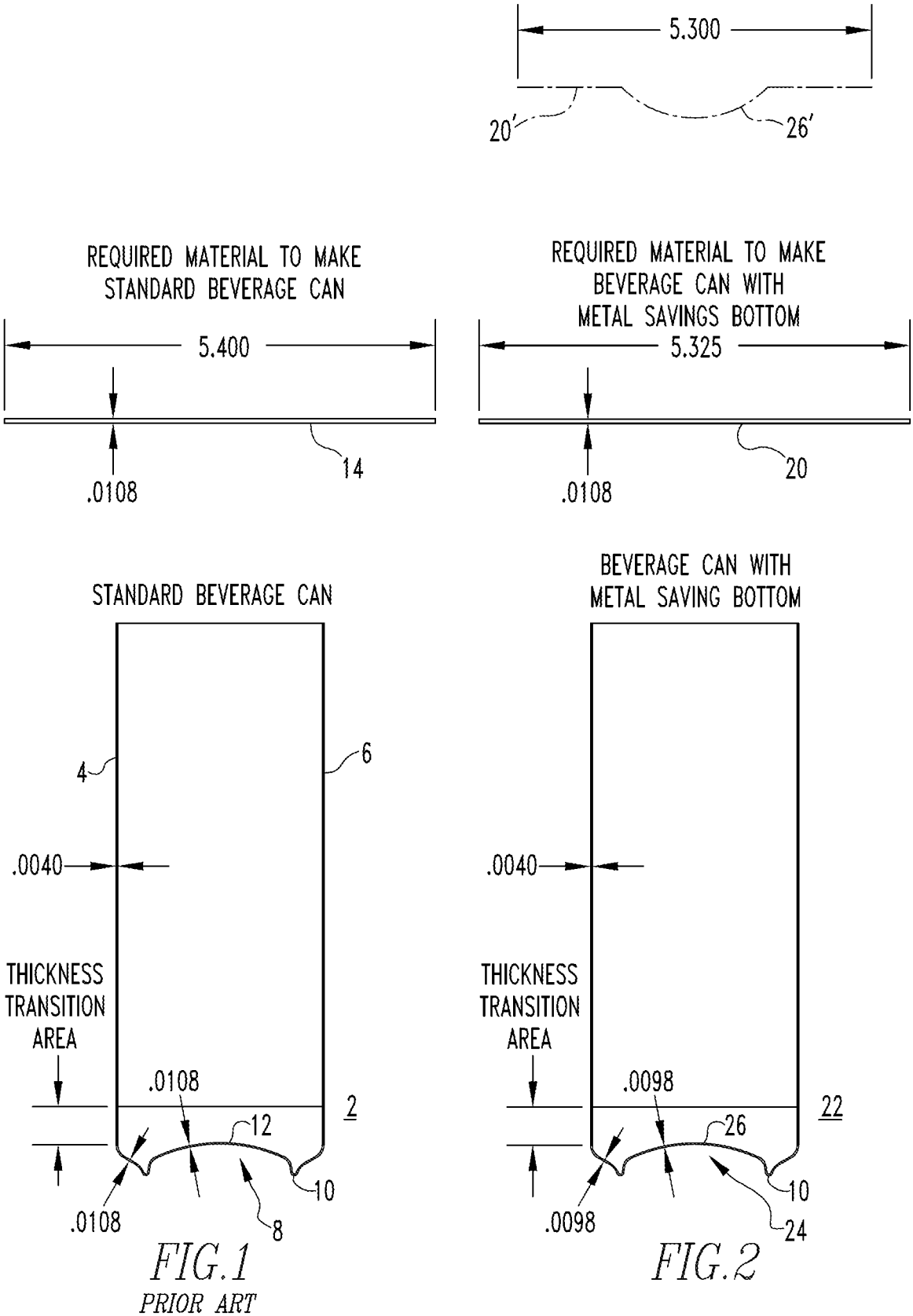
FIG.1 PRIOR ART
FIG. 1 is a side elevation view of a beverage can and a blank of material used to form the beverage can.
FIG. 2 is a side elevation view of one non-limiting example of a container and a blank from which the container is formed in accordance with an embodiment of the disclosed concept, also showing, in phantom line drawing, a pre-formed blank of material in accordance with another aspect of the disclosed concept.

For purposes of illustration, embodiments of the disclosed concept will be described as applied to cups, although it will become apparent that they could also be employed to suitably stretch the end panel or bottom portion of any known or suitable can body or container (e.g., without limitation, beverage/beer cans; food cans).

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As employed herein, the singular form of "a," "an," and "the" include plural references unless the context clearly dictates otherwise.

As employed herein, the statement that two or more parts or components are "coupled" shall mean that the parts are joined or operate together either directly or indirectly, i.e., through one or more intermediate parts or components, so long as a link occurs. As employed herein, "directly coupled" means that two elements are directly in contact with each other. It is noted that moving parts, such as but not limited to circuit breaker contacts, are "directly coupled" when in one position, e.g., the closed, second position, but are not "directly coupled" when in the open, first position. As employed herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof.

As employed herein, the phrase "removably coupled" means that one component is coupled with another component in an essentially temporary manner. That is, the two components are coupled in such a way that the joining or separation of the components is easy and would not damage the components. For example, two components secured to each other with a limited number of readily accessible fasteners are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As employed herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As employed herein, a "coupling assembly" includes two or more couplings or coupling components. The components of a coupling or coupling assembly are generally not part of the same element or other component. As such, the components of a "coupling assembly" may not be described at the same time in the following description.

As employed herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As employed herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. With regard to surfaces, shapes, and lines, two, or more, "corresponding" surfaces, shapes, or lines have generally the same size, shape, and contours.

As employed herein, and in the phrase "[x] moves between a first position and a second position corresponding to [y] first and second positions," wherein "[x]" and "[y]" are elements or assemblies, the word "correspond" means that when element [x] is in the first position, element [y] is in the first position, and, when element [x] is in the second position, element [y] is in the second position. It is noted that "correspond" relates to the final positions and does not mean the elements must move at the same rate or simultaneously. That is, for example, a hubcap and the wheel to which it is attached rotate in a corresponding manner. Conversely, a spring biased latched member and a latch release move at different rates. Thus, as stated above, "corresponding" positions mean that the elements are in the identified first positions at the same time, and, in the identified second positions at the same time.

As employed herein, the statement that two or more parts or components "engage" one another shall mean that the elements exert a force or bias against one another either directly or through one or more intermediate elements or components. Further, as employed herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A either engages element B while in element A first position.

As employed herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate.

As employed herein, the word "unitary" means a component that is created as a single piece or unit. That is, a component that includes pieces that are created separately and then coupled together as a unit is not a "unitary" component or body.

As employed herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as employed herein, "structured to [verb]" recites structure and not function. Further, as employed herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As employed herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As employed herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e., the named element or assembly that precedes the pronoun "its."

As employed herein, simultaneous engagement by elements disposed generally in opposition to each other is identified as "clamping." That is, as employed herein, to "clamp" means to secure a material in a substantially fixed position so as not to permit the material to move (e.g., slide) or flow in at least one direction. Thus, as employed herein, a material that is "clamped" is secured in a substantially fixed position so as not to permit the material to move (e.g., slide) or flow in at least one direction, for example, the clamped material cannot move/flow to the bottom portion of a cup.

As employed herein, "stretch" means to increase in length or area without any additional material substantially moving/flowing into the material being formed. Thus, as employed herein, "stretching" is not "ironing" or "drawing" the material because, as used herein, those processes allow additional material to move/flow into the material being formed. Thus, a material that is "stretched," as employed herein, has one dimension (e.g., length/area) of the material being increased and another dimension of the material (e.g., thickness) being decreased.

As employed herein, simultaneous engagement by elements disposed generally in opposition to each other wherein the force of the engagement increases is identified as "progressive clamping." That is, as employed herein, to "progressively clamp" means to secure a material in a substantially fixed position while initially allowing material to move (e.g., slide) or flow in at least one direction through the "progressively clamped" area. As the force of the engagement increases, the amount of material that moves/flows through the "progressively clamped" area decreases until the amount is negligible. Thus, as employed herein, a material that is "progressively clamped" is secured in a substantially fixed position while allowing some material flow after initially being "progressively clamped" and wherein the force of the engagement increases so as to permit only a negligible amount of material to move/flow through the "progressively clamped" area.

As employed herein, "progressively stretch" means to increase in length or area with an initial flow of material into the material being formed and wherein the initial flow of material into the material being formed is reduced to a negligible amount of material so that, at the end of the "progressively stretching" process, almost no additional material is moving/flowing into the material being formed. Thus, as employed herein, "progressively stretching" is not "ironing" or "drawing" the material because, as used herein, those processes allow additional material to move/flow into the material being formed. Thus, a material at the end of a "progressively stretching" process as employed herein, has one dimension (length/area) of the material being increased and another dimension of the material (thickness) being decreased.

As employed herein, the terms "can" and "container" are used substantially interchangeably to refer to any known or suitable container, which is structured to contain a substance (e.g., without limitation, liquid; food; any other suitable substance), and expressly includes, but is not limited to, beverage cans, such as beer and soda cans, as well as food cans.

As employed herein, the terms "tooling," "tooling assembly" and "tool assembly" are used substantially interchangeably to refer to any known or suitable tool(s) or component(s) used to form (e.g., without limitation, stretch) shells in accordance with the disclosed concept.

As employed herein, the term "fastener" refers to any suitable connecting or tightening mechanism expressly including, but not limited to, screws, bolts and the combinations of bolts and nuts (e.g., without limitation, lock nuts) and bolts, washers and nuts.

As employed herein, the term "number" shall mean one or an integer greater than one (i.e., a plurality).

As employed herein, the term "bead" when used in reference to the formed material means a protrusion relative to at least one surface of the material. Further, as employed herein, the term "bead" when used in reference to the tooling means the elements of the tooling that form the bead in the material. The elements of the tooling that form the bead, i.e., the tooling "bead" elements, are in one or both of the upper tooling and/or lower tooling.

FIG. 2 shows a blank of material 20 and a beverage can 22, i.e., a "can body," having a selectively formed bottom profile 24 in accordance with one non-limiting example in accordance with the disclosed concept. Specifically, as described in detail hereinbelow, the material in the can bottom profile 24 and, in particular the domed portion 26 thereof, has been stretched, thereby thinning it. Although the example of FIG. 2 shows a beverage can, it will be appreciated that the disclosed concept can be employed to stretch and thin the bottom portion of any known or suitable alternative type of container (e.g., without limitation, food can (not shown)), or cup (see, for example, cup 122 of FIGS. 9A-9D and 11A-11D, and cup 222 of FIGS. 10A-10C), which is subsequently further formed into such a container.

It will also be appreciated that the particular dimensions shown in FIG. 2 (and all of the figures provided herein) are provided solely for purposes of illustration and are not limiting on the scope of the disclosed concept. That is, any known or alternative thinning of the base gauge could be implemented for any known or suitable container, end panel, or cup, without departing from the scope of the disclosed concept. In the non-limiting example of FIG. 2, the can body 22 has a wall thickness of 0.0040 inch and a substantially uniform thickness in the can bottom profile 24 and domed portion 26 of 0.0098 inch. Thus, the material in the can bottom profile 24 has been thinned by about 0.0010 inch from the base gauge of the blank of material 20 of 0.0108 inch. It will be appreciated that this is a substantial reduction, which results in significant weight reduction and cost savings over conventional cans (see, for example, the can body 2 of FIG. 1 having a can bottom profile 8 thickness of 0.0108 inch). Additionally, among other advantages, this enables a smaller blank of material to be used to form the same can body. For example and without limitation, the blank of material 20 in the non-limiting example of FIG. 2 has a diameter of about 5.325 inches, whereas the blank of material 14 of FIG. 1 has a diameter of about 5.400 inches. This, in turn, enables a shorter coil width (not shown) of material to be employed (i.e., supplied to the tooling), resulting in less shipping cost.

Moreover, the disclosed concept achieves material thinning and an associated reduction in the overall amount and weight of material, without incurring increased material processing charges associated with the stock material that is supplied to form the end product. For example, and without limitation, increased processing (e.g., rolling) of the stock material to reduce the base gauge (i.e., thickness) of the material can undesirably result in a relatively substantial increase in initial cost of the material. The disclosed concept achieves desired thinning and reduction, yet uses stock material having a more conventional and, therefore, less expensive base gauge.

Continuing to refer to FIG. 2, it will be appreciated that the disclosed concept could employ, or be implemented to be employed with, preformed blanks of material 20'. For example and without limitation, a preformed blank of material 20' having a preformed dome portion 26' is shown in phantom line drawing in FIG. 2. Such a preformed blank 20' could be fed to the tooling 300 (FIG. 3), 300' (FIGS. 4-8) and subsequently further formed into the desired cup 122 (FIGS. 9A-9D and 11A-11D), 222 (FIGS. 10A-10C) or container 22 (FIG. 1). One advantage of such a preformed blank of material 20', is the ability of a plurality of such blanks 20' to nest, one within another, for purposes of transporting and shipping the blanks 20'. The preformed dome portion 26' also provides a mechanism to grab and orient the blank 20' within the tooling 300 (FIG. 3), 300' (FIGS. 4-8), as desired. Furthermore, it also enables the width of the blank 20' to be still further reduced. For example and without limitation, in the non-limiting example of FIG. 2, the preformed blank 20' has a reduced diameter of 5.300 inches.

FIGS. 3-8 show various tooling 300 (FIG. 3), 300' (FIGS. 4-8) for stretching and thinning the container material (e.g., without limitation, blank; cup; can body), in accordance with the disclosed concept. Specifically, the selective forming (e.g., stretching) is accomplished by way of precise tooling geometry and placement. In accordance with one non-limiting embodiment, the process begins by introducing a blank of material (e.g., without limitation, blank 20) between components of a tooling assembly 300 (FIG. 3), 300' (FIGS. 4-8), and forming a standard flat bottom cup 122 (see, for example, FIGS. 9A and 10A) with base metal thickness or gauge.

Figure 3:
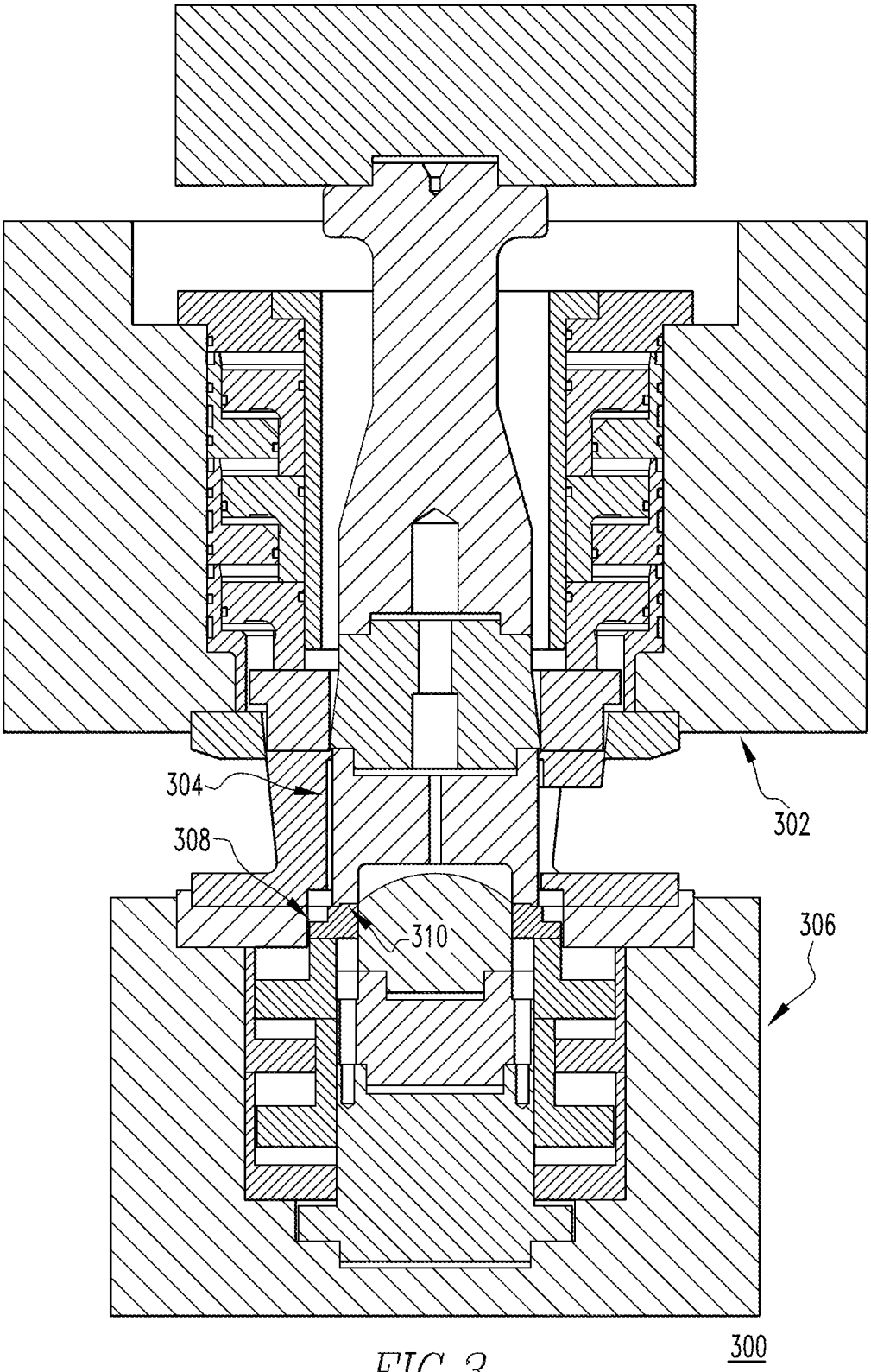
FIG. 3 is a side elevation section view of tooling in accordance with an embodiment of the disclosed concept.
Figure 4:
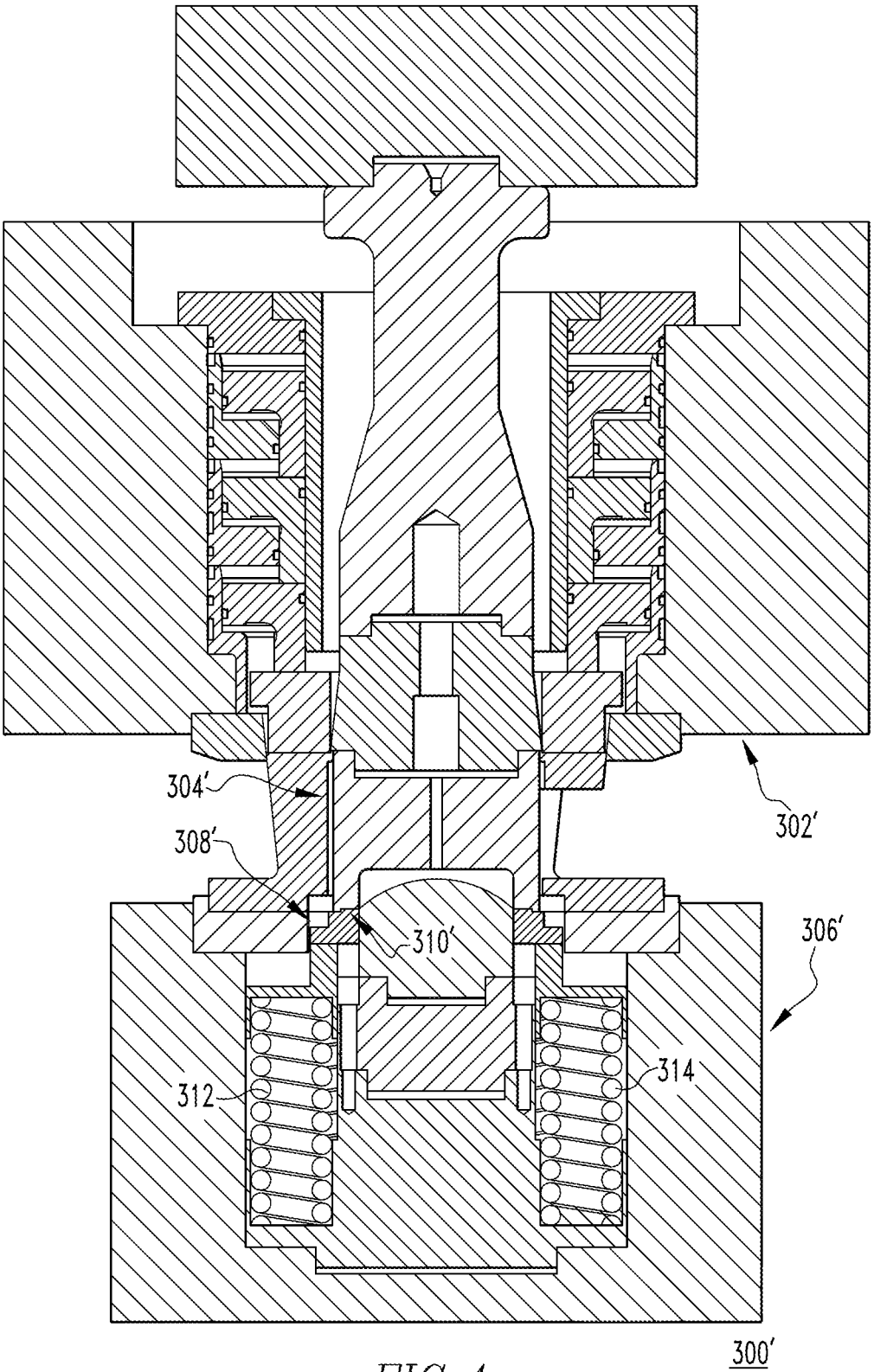
FIG. 4 is a side elevation section view of tooling in accordance with another embodiment of the disclosed concept.
Figure 5:
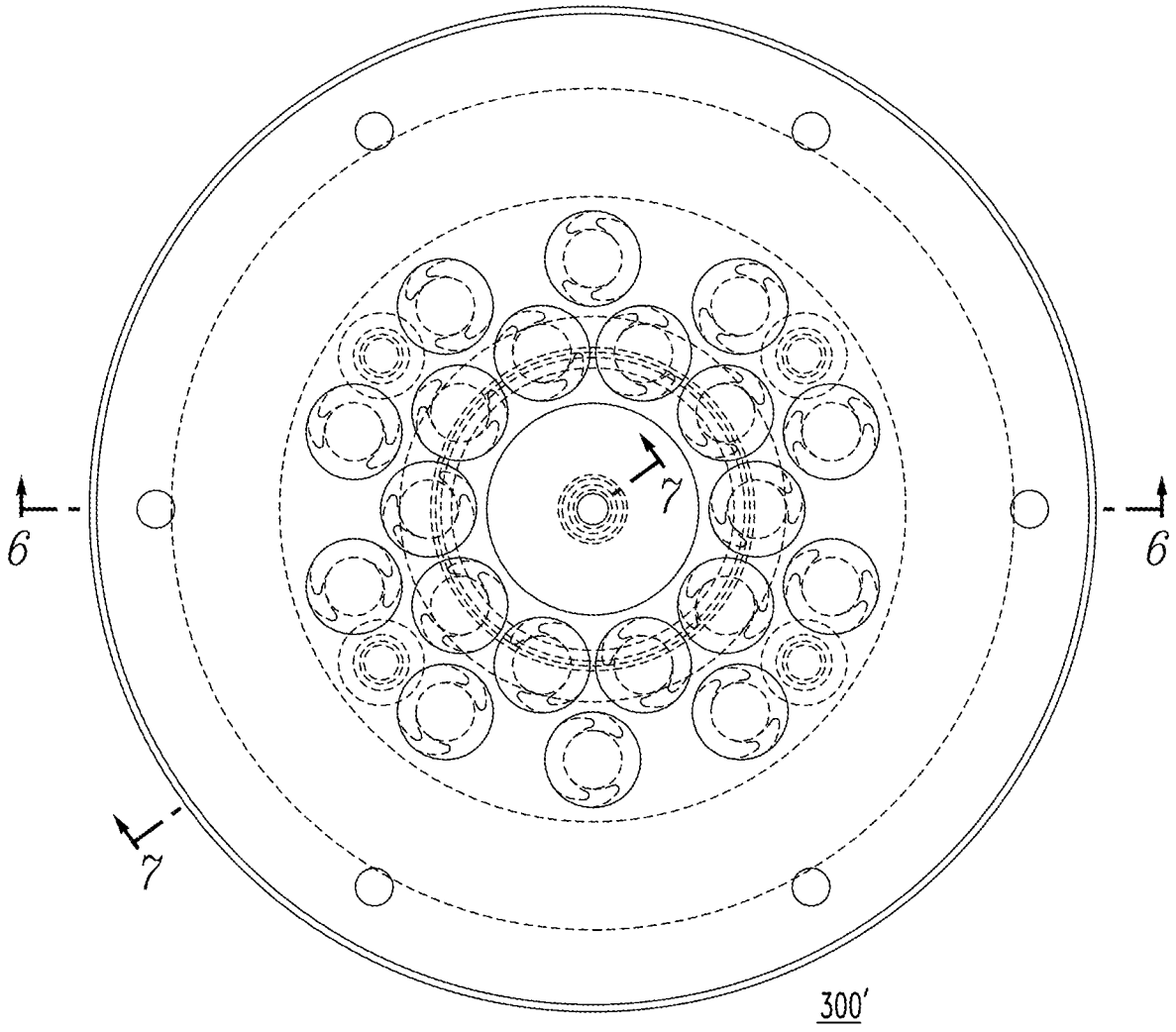
FIG. 5 is a top plan view of a portion of the tooling of FIG. 4.
Figure 6:
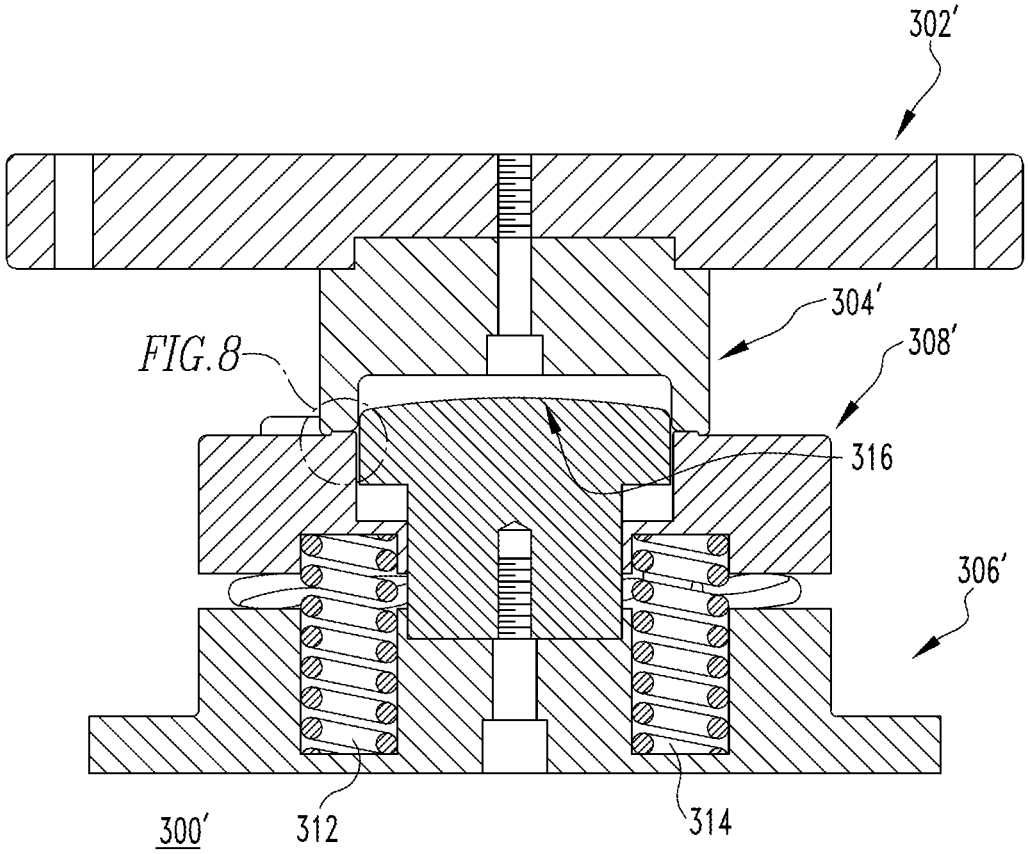
FIG. 6 is a section view taken along line 6-6 of FIG. 5.
Figure 7:
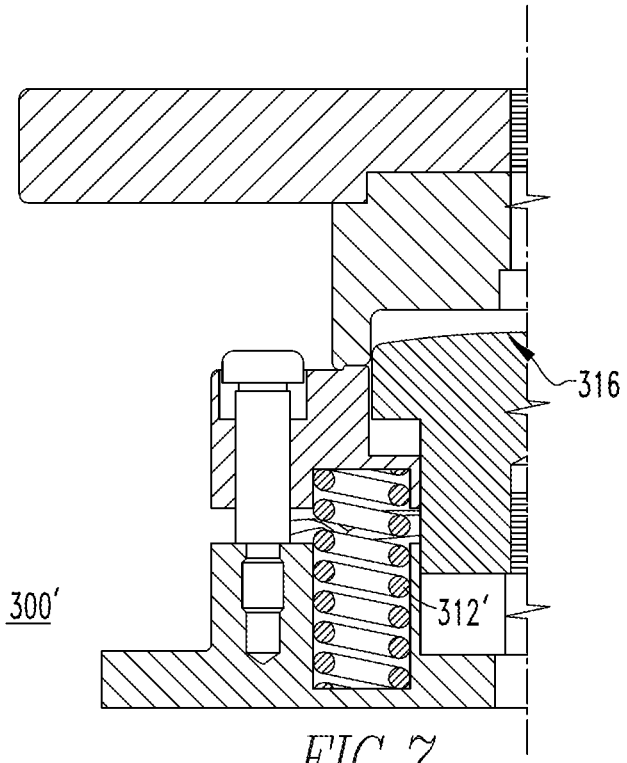
FIG. 7 is a section view taken along line 7-7 of FIG. 5.

As shown in FIGS. 3 and 4, the tooling 300 preferably includes an upper tool assembly 302, 302' (FIG. 4) with a forming punch 304 (FIG. 3), 304' (FIG. 4), and, a lower tool assembly 306 (FIG. 3), 306' (FIG. 4). As is known, the upper tool assembly 302, 302' moves between a first position, wherein the upper tool assembly 302, 302' is spaced from the lower tool assembly 306, 306', and a second position, wherein the upper tool assembly 302, 302' is immediately adjacent and minimally spaced from the lower tool assembly 306, 306'. That is, as the upper tool assembly 302, 302' moves from the first position to the second position, the forming punch 304, 304' engages and deforms the can 22 or cup 122, 222.

Figure 8:
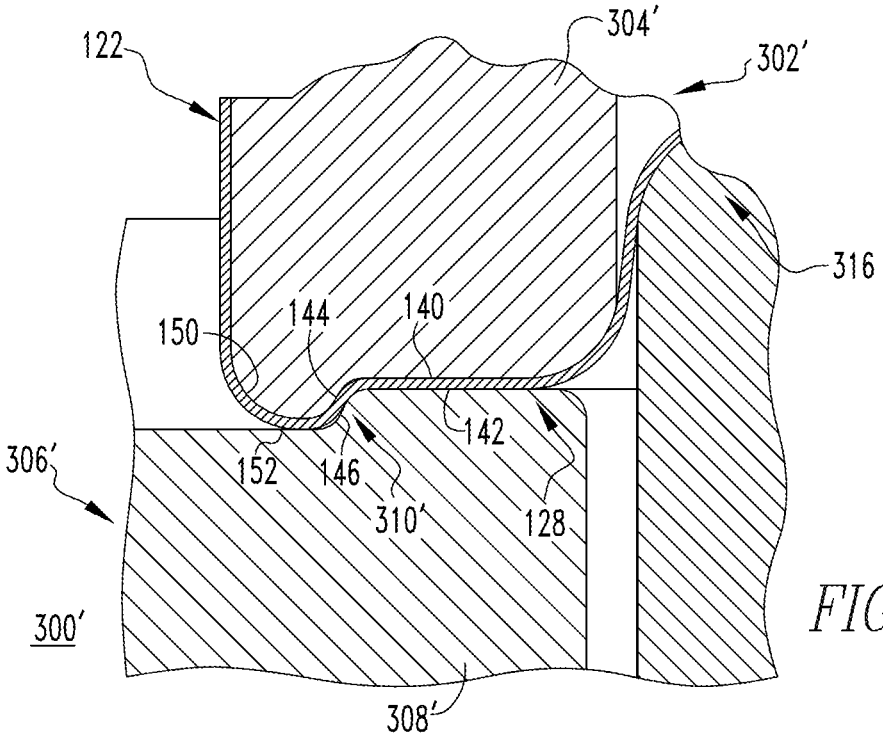
FIG. 8 is an enlarged view of segment 8 of FIG. 6.
Figure 14:
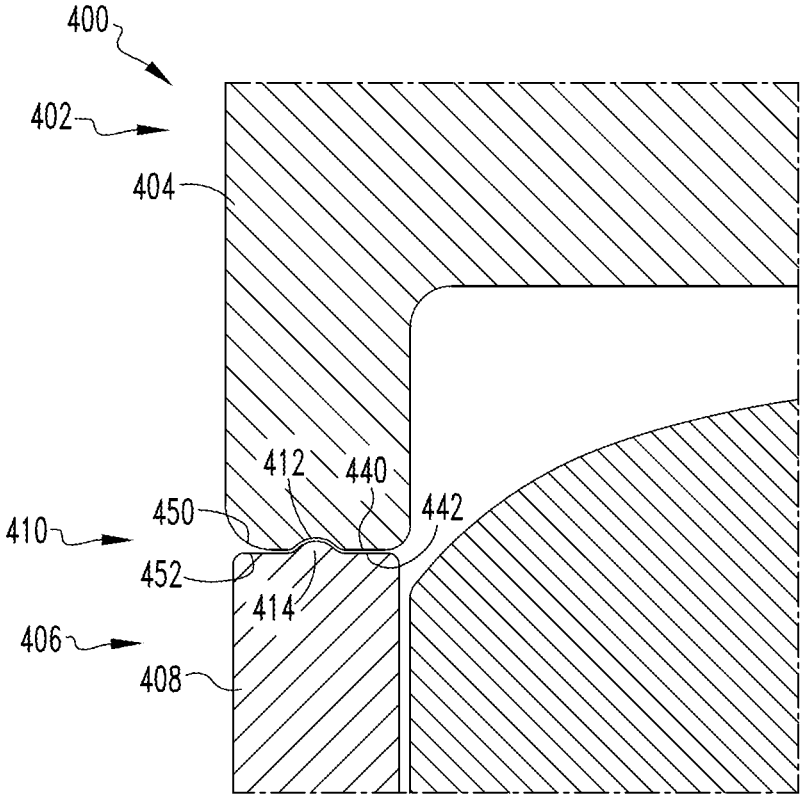
FIG. 14 is an enlarged view of an alternate embodiment of a forming surface including a single clamp bead.

After the cup 122, 222 is formed, the forming punch 304, 304' continues moving downward, pushing the cup 122, 222 lower until the cup 122, 222 contacts a lower pad 308, 308'. In the non-limiting embodiment shown and described herein, the forming punch 304, 304' and lower pad 308, 308' have a contoured step bead 310 (best shown in the enlarged view of FIG. 8 as step bead 310' in lower pad 308'), although it will be appreciated that such a step bead is not required. That is, as shown in FIGS. 8 and 14, the lower end of the forming punch 304, 304' and the upper end of the lower pad 308, 308' have a generally planar inner portion 140, 142, respectively. The forming punch shown in FIGS. 3 and 4, forming punch 304, 304', further includes a curvilinear outer portion 150. The lower pad 308, 308' has a generally planar outer portion 152. The contoured step bead 310, 310' facilitates holding the material substantially stationary, for example, by crimping it and locking the material just inboard of the cup sidewall 124 described below, as shown in FIG. 8. That is, the forming punch inner portion 140 and the lower pad inner portion 142 are structured to clamp the cup sidewall 124. In this manner, the material in the sidewall 124 is held securely, preventing it from sliding or flowing into the bottom portion 128 of the cup 122.

Accordingly, it will be appreciated that the disclosed concept differs substantially from conventional container bottom forming (e.g., without limitation, doming) methods and apparatus. That is, while the side portions of the cup or container in a traditional forming process might be clamped, relatively little pressure is applied so that movement (e.g., sliding; flowing) of the material into the bottom portion of the cup or container is promoted. In other words, traditionally clamping and stretching the material in the bottom portion of the container was expressly avoided, so as to maintain the thickness of the material in the bottom portion.

It will be appreciated that the aforementioned step bead 310, 310' is not a required aspect of the disclosed concept. For example, FIGS. 9A-9D illustrate the consecutive steps or stages of forming a non-limiting example cup 122 in accordance with an embodiment of the disclosed concept wherein the tooling 300, 300' includes the step bead 310, 310', whereas FIGS. 10A-10C illustrate the consecutive forming stages of a cup 222 in accordance with another embodiment of the disclosed concept wherein the tooling does not include any step bead. That is, in this embodiment, the forming punch 304, 304' and lower pad 308, 308' have a generally planar inner portion 140, 142, respectively. The forming punch 304, 304' further includes a curvilinear outer portion 150. The lower pad 308, 308' has a generally planar outer portion 152. Thus, in this embodiment, there is no angled portion 144, 146 on either the forming punch 304, 304', 304A or lower pad 308, 308'.

It will be appreciated that while four forming stages are shown in FIGS. 9A-9D and three forming stages are shown in the example of FIGS. 10A-10C, that any known or suitable alternative number and/or order of forming stages could be performed to suitably stretch and thin material in accordance with the disclosed concept. It will further be appreciated that any known or suitable mechanism for sufficiently securing the material to resist movement (e.g., sliding) or flow of the material into the bottom portion 128 (e.g., a contoured shape or dome 130) could be employed, without departing from the scope of the disclosed concept. For example and without limitation, pressure to secure the sidewalls 124, 126 of the cup 122 or container body 22 (FIG. 2), or locations proximate thereto, can be provided pneumatically, as generally shown in FIG. 3, or by a predetermined number of biasing elements (e.g., without limitation, springs 312, 314), as shown in FIGS. 4-7, or by any other known or suitable holding means (e.g., without limitation, hydraulic force) or mechanism (not shown).

In accordance with one non-limiting embodiment of the disclosed concept, it will be appreciated that although the material is clamped (e.g., secured in a substantially fixed position) so as not to permit it to move (e.g., slide) or flow, and to instead be stretched in a subsequent forming step, the amount of force (e.g., pressure) that is necessary to apply such a clamping effect, is preferably minimized. In this manner, it is possible to provide the necessary clamping force to facilitate the disclosed stretching and thinning, without requiring a different press (e.g., without limitation, a press having greater capacity) (not shown). Accordingly, the disclosed concept can advantageously be readily employed with existing equipment in use in the field, by relatively quickly and easily retooling the existing press.

Table 1 quantifies the clamping force and deflection resulting from employing different numbers (e.g., 5; 10; 20) of springs (e.g., without limitation, springs 312, 314) to apply the clamping force in accordance with several non-limiting example embodiments of the disclosed concept.

TABLE 1

| deflection (mm) | | load (kg) | deflection (in) | load (lbs) | ×5 springs | ×10 springs | ×20 springs |
|---|---|---|---|---|---|---|---|
| 4 | 6.2% | 60 | 0.16 | 132.2 | 661.2 | 1,322.4 | 2,644.8 |
| 10.4 | 16.0% | 156 | 0.41 | 343.8 | 1,719.1 | 3,438.2 | 6,876.5 |
| 11 | 16.9% | 176 | 0.43 | 387.9 | 1,939.5 | 3,879.0 | 7,758.1 |
| 13 | 20.0% | 195 | 0.51 | 429.8 | 2,148.9 | 4,297.8 | 8,595.6 |

In another exemplary embodiment, Table 2 quantifies the clamping force and deflection for a system forming aluminum, or steel, shells on a dual action press and forming shells on a dual action press. It is noted that the spring deflection associated with forming aluminum is 0.410 inch and the spring deflection associated with forming steel is 0.810 inch. Further, in this example, there are fifteen tooling stations associated with forming aluminum and nine tooling stations associated with forming steel. Further, in this example, the press is a one-hundred and fifty ton press with a 75 ton (150,000 lbf) capacity for each of the inner slide (also identified as the punch 404A, below) and the outer slide.

| Cup Material | Max. % Thinning | % of Free Length | Force Limit Per Tooling Pocket (lb/station) | ×8 springs Spring Load Limit/ Spring (lbs) | ×8 springs Spring Stiffness Limit/ Spring (lb/in) | ×10 springs Spring Load Limit/ Spring (Lbs) | ×10 springs Spring Stiffness Limit/ Spring (lb/in) |
|---|---|---|---|---|---|---|---|
| Aluminum | 10.0% | 8.2% | 10000 | 1250 | 3049 | 1000 | 2439 |
| Steel | 25.0% | 16.2% | 16667 | 2083 | 2572 | 1667 | 2058 |

It is noted that spring deflection generally corresponds to the maximum dome thinning. That is, for a one-hundred and fifty ton press the inner and outer slides can support 75 ton (150,000 lbf). Therefore, in relation to a single spring forming aluminum in a 15-out configuration, there is 150,000 lbf per each of the 15 "pockets", resulting in an about 10,000 lbf force limit per tooling pocket. Further, in this example, each pocket has eight springs. Thus, 10,000 lbf/eight spring means that there is 1,250 lbf acting on each spring. When each spring has a stiffness of 3049 lb/in and has 1,250 lbf acting on it, it will be deflected 0.410 inch. This corresponds to the maximum thinning of an aluminum dome, i.e., about 10%. Thus, it is understood that the variables, e.g., the number of springs, stiffness, etc. are related to the maximum limits of the press and the desired spring deflection (which corresponds to the thinning of the dome). Structuring the tooling 300 so that the total load is less than the limit of the press, as discussed below, solves the problems stated above.

Once the peripheral material is suitably clamped (e.g., secured in a substantially fixed in position, as shown for example and without limitation in FIG. 8), the punch 304' continues to move downward, forcing the material in the cup bottom portion 128 to be forced into the contour 316 (FIGS. 6-8) of the tools 300' causing the material to stretch into the contoured shape 130 (also identified as a "dome" and is shown in FIGS. 9D, 10C, 11A-11D, 12 and 13), thereby thinning the material. A non-limiting example of a cup 122 which has been formed in accordance with this process is shown in FIGS. 9A-9D (tooling 300' includes step bead 310'). Another example cup 222 is shown in FIGS. 10A-10C (tooling does not include step bead). It will be appreciated, for example with reference to FIG. 9D, that the material in the contoured shape or dome 130 (FIGS. 9D and 11D), 230 (FIG. 10C) can be stretched and, therefore, thinned by up to about 0.001 inch, or more. It will also be appreciated that while the contoured shape in the example shown and described herein is a dome 130, 230, that any other known or suitable alternative shapes could be formed without departing from the scope of the disclosed concept.

Figure 9A:
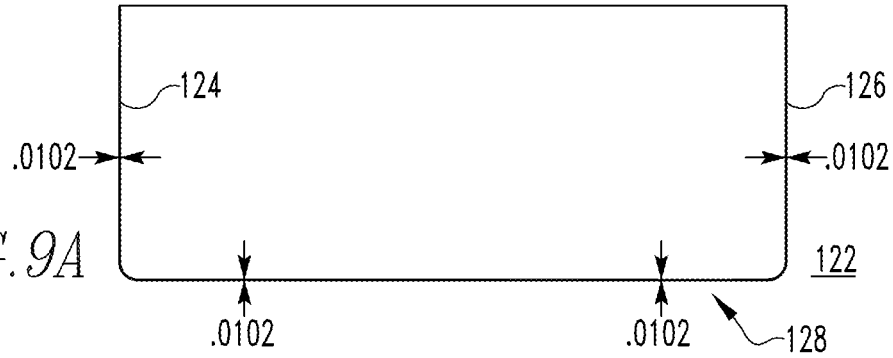
FIGS. 9A-9D are side elevation views of consecutive forming stages of a cup, in accordance with a non-limiting example embodiment of the disclosed concept.
Figure 9B:
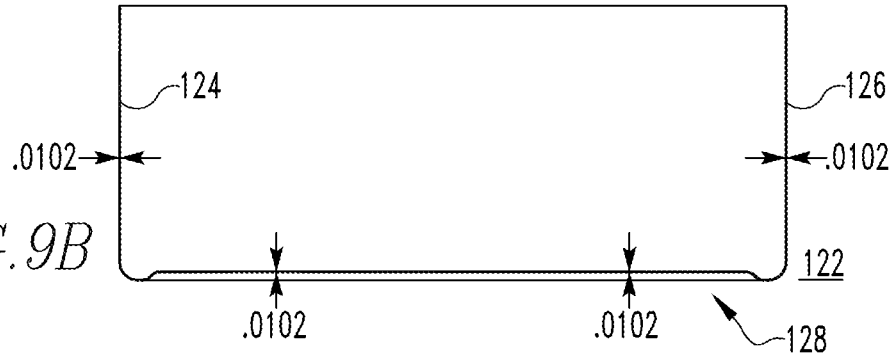
Figure 9C:
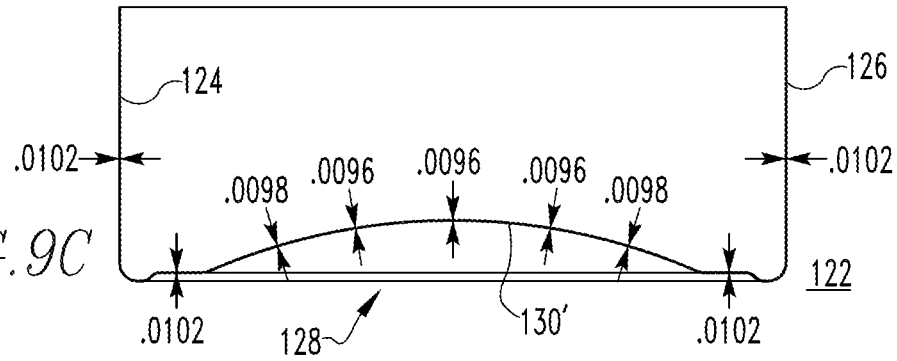
Figure 9D:
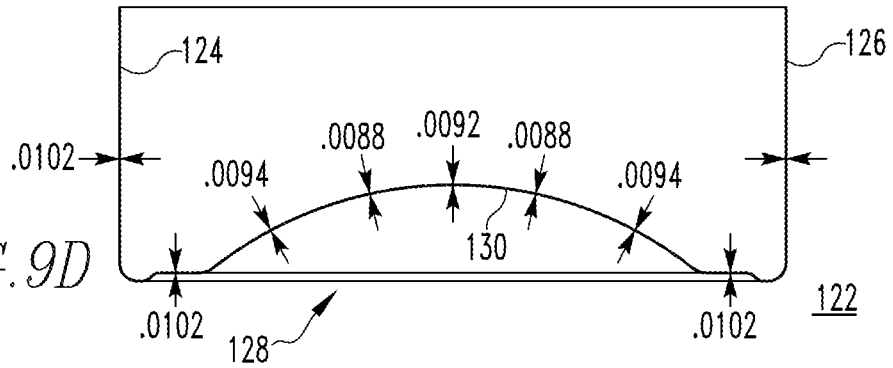
Figure 10A:
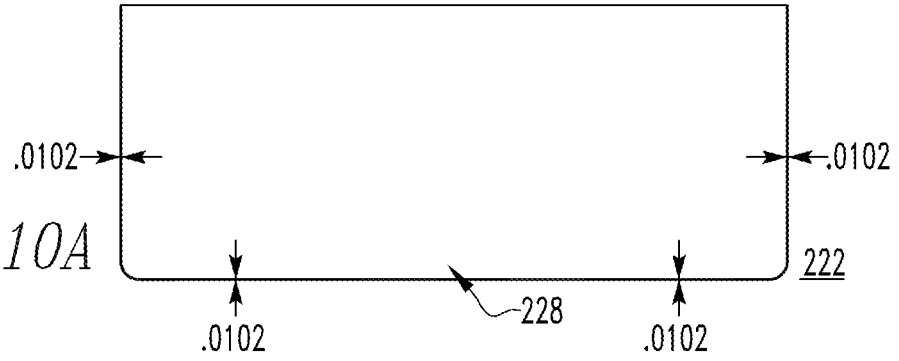
FIGS. 10A-10C are side elevation views of consecutive forming stages of a cup, in accordance with another non-limiting example embodiment of the disclosed concept.
Figure 10B:
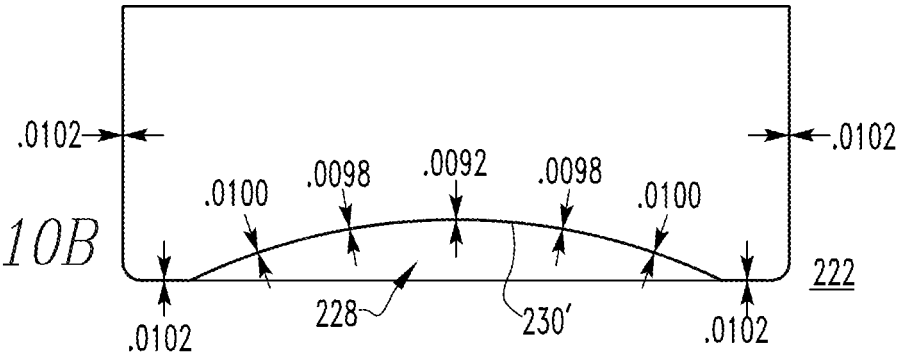
Figure 10C:
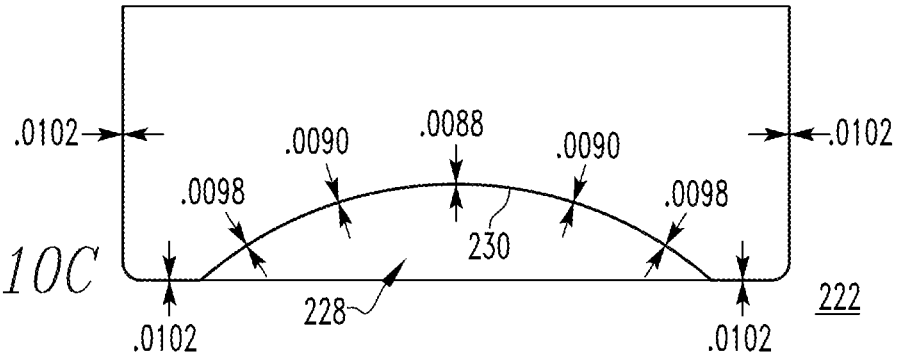
Figure 11A:
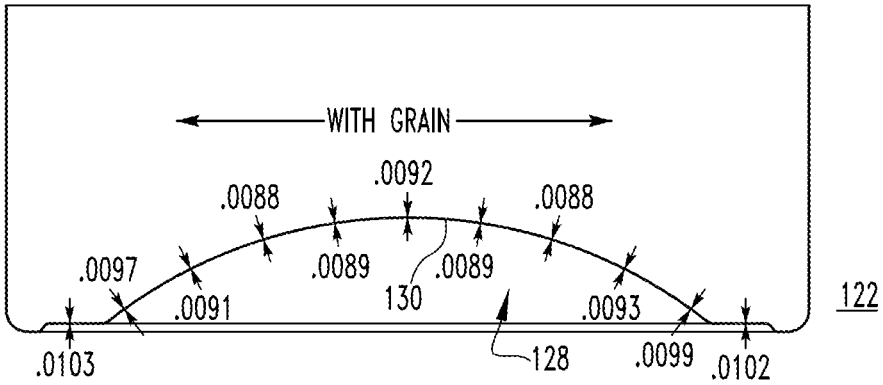
FIGS. 11A-11D are side elevation views showing the metal thickness of the cup thinned in accordance with a non-limiting example embodiment of the disclosed concept, respectively showing the substantial uniform thickness of the dome in a direction with the grain of the material, in a direction against the grain, in a direction at 45 degrees with respect to the grain, and in a direction 135 degrees with respect to the grain.
Figure 11B:
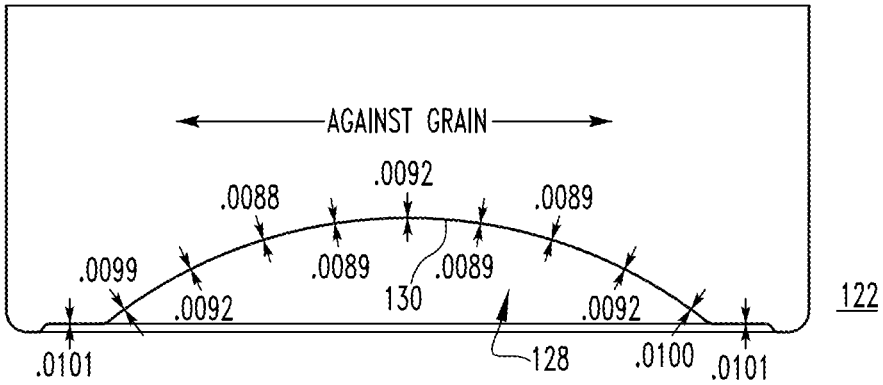
Figure 11C:
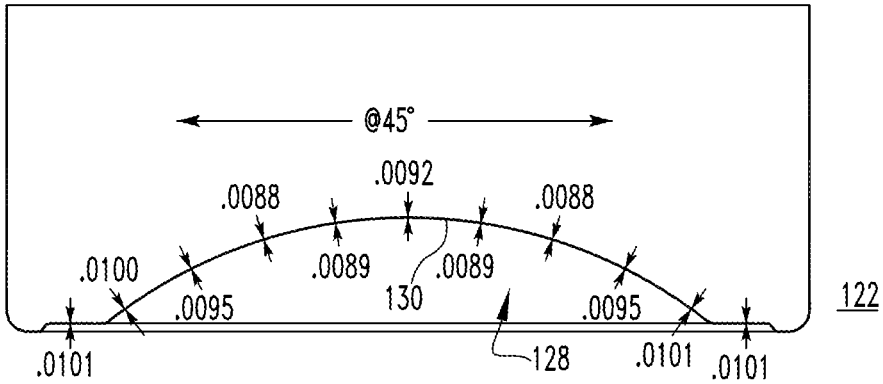
Figure 11D:
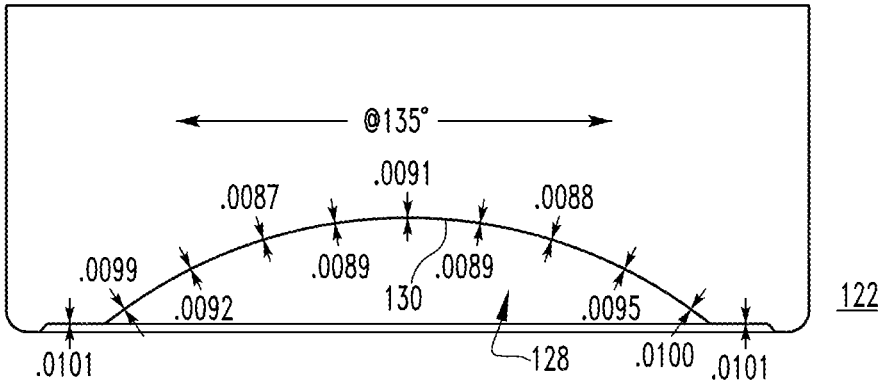
Figure 12:
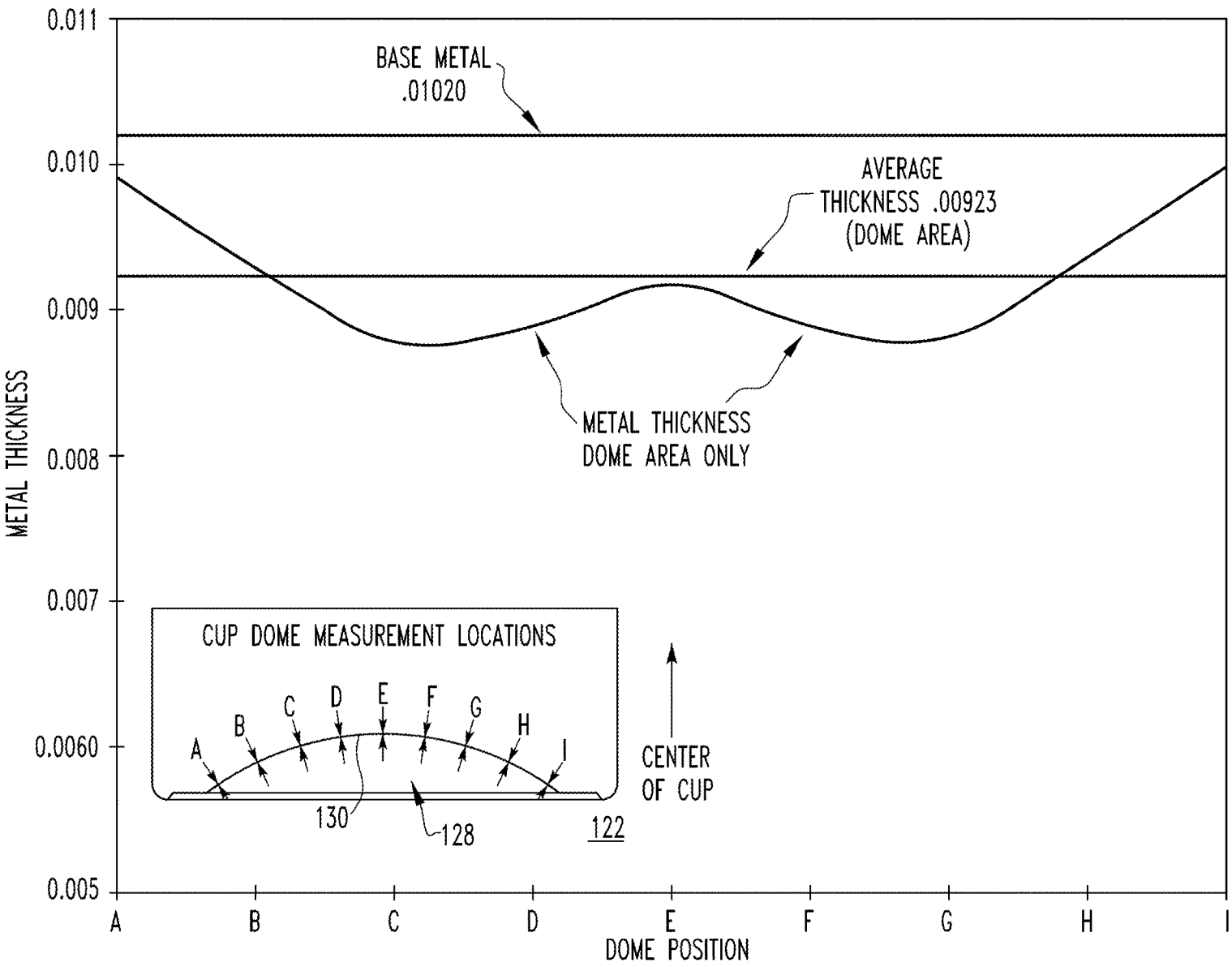
FIG. 12 is a graph plotting the metal thickness of the dome at various locations of the dome, in accordance with a non-limiting example embodiment of the disclosed concept.
Figure 13:
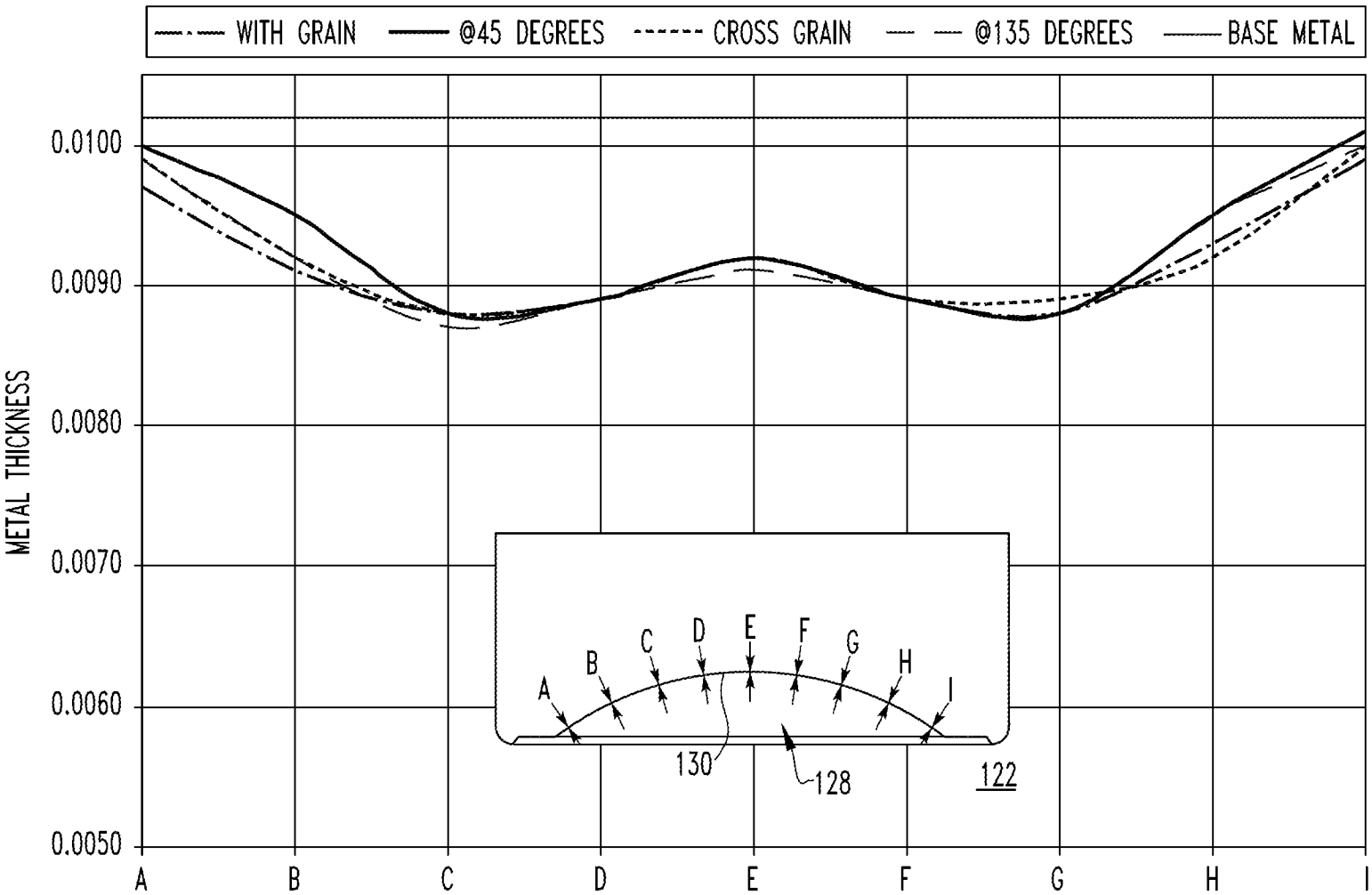
FIG. 13 is a graph plotting the metal thickness of the base metal and of the dome at the various locations of the dome of FIG. 12, for each of the directions of FIGS. 11A-11D, as well as in the cross grain direction.

Referring to FIGS. 9C, 9D, 11A-11D, 12 and 13, it will be appreciated that the stretched material of the dome 130 is also advantageously substantially uniform in thickness. More specifically, the material is uniform in thickness not only for various locations (see, for example, measurement locations A-I of FIGS. 12 and 13) along the width or diameter of the dome 130, as shown in FIGS. 9C (partially formed cup dome 130') and 9D (completely formed cup dome 130), but also in various directions, such as with the grain as shown in FIGS. 11A and 13, against the grain as shown in FIGS. 11B and 13, at 45 degrees with respect to the grain as shown in FIGS. 11C and 13, and at 135 degrees with respect to the grain, as shown in FIGS. 11D and 13. The graphs of FIGS. 12 and 13 further confirm these findings. FIG. 13 shows, in one graph, a plot of the metal thicknesses at locations A-I for each of the foregoing directions with respect to the grain, as well as in the cross grain direction.

Accordingly, it will be appreciated that the disclosed concept provides tooling 300 (FIG. 3), 300' (FIGS. 4-8) and methods for selectively stretching and thinning the bottom profile 24 (FIG. 2), bottom portion 128 (FIGS. 9A-9D and 11A-11D), and bottom profile 228 (FIGS. 10A-10C) of a container 22 (FIG. 2) or cup 122 (FIGS. 9A-9D and 11A-11D), 222 (FIGS. 10A-10C), such as a domed portion 26 (FIG. 2), dome 130 (FIGS. 9D and 11A-11D), and dome 230 (FIG. 10C), thereby providing relatively substantially material and cost savings.

Figure 16A:
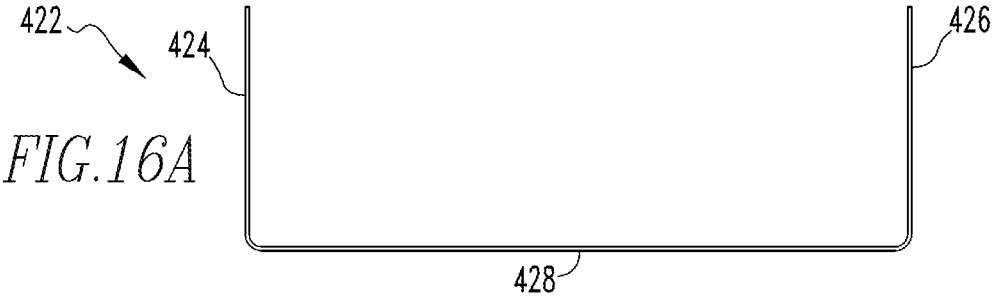
FIGS. 16A-16D are side elevation views of consecutive forming stages of a cup, in accordance with a non-limiting example embodiment of the disclosed concept.
Figure 16B:
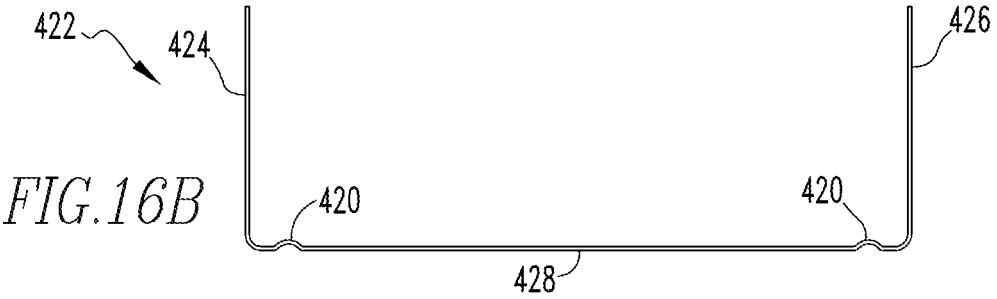
Figure 16C:
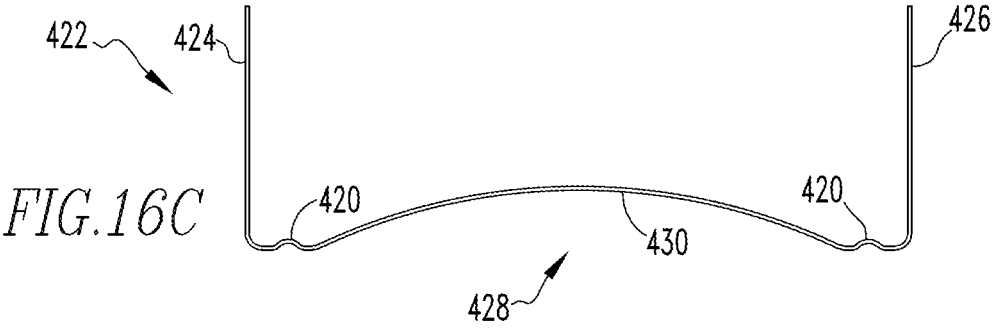
Figure 16D:
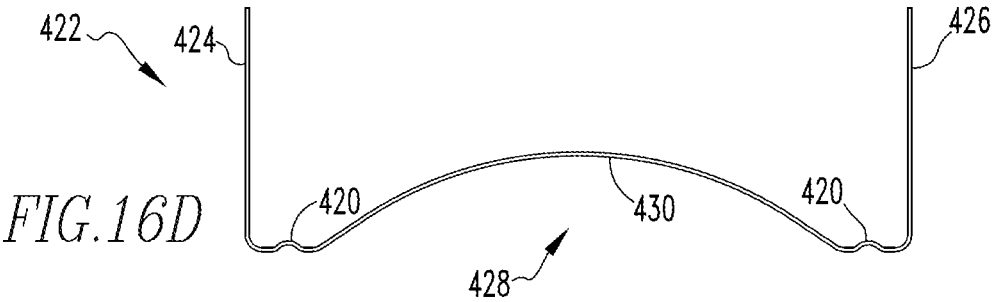

In another exemplary embodiment, the disclosed concept provides tooling 400 and methods for selectively stretching and thinning the bottom profile 24 of a container 22 or cup 122, including a domed portion 330 by utilizing a (tooling) clamp bead 410 (discussed below). As noted above, in reference to tooling 400, utilizing a clamp bead means that the tooling 400, i.e., the upper tool assembly 402 and the lower tool assembly 406, include construct(s) structured to form "clamp beads." That is, and as used herein, the "upper tool assembly and the lower tool assembly include a number of clamp beads" means that the tooling 400, i.e., the upper tool assembly 402 and the lower tool assembly 406, include construct(s) structured to form "clamp beads," as defined above. In this exemplary embodiment, and as shown in FIGS. 16A-16B, the material forms a cup 422 including sidewalls 424, 426 and a bottom portion 428.

In this embodiment, shown in FIGS. 14-18, the tooling 400 preferably includes an upper tool assembly 402 with a forming punch 404, and, a lower tool assembly 406. It is understood that the tooling 400 identified by reference number "400" also include the other elements of the tooling identified by reference numbers "300, 300'" with the differences noted below. As described above, the upper tool assembly 402 also moves between a first position, wherein the upper tool assembly 402 is spaced from the lower tool assembly 406, and a second position, wherein the upper tool assembly 402 is immediately adjacent and minimally spaced from the lower tool assembly 406. That is, as the upper tool assembly 402 moves from the first position to the second position, the forming punch 404 engages and deforms the can 22 or cup 122.

Figure 15:
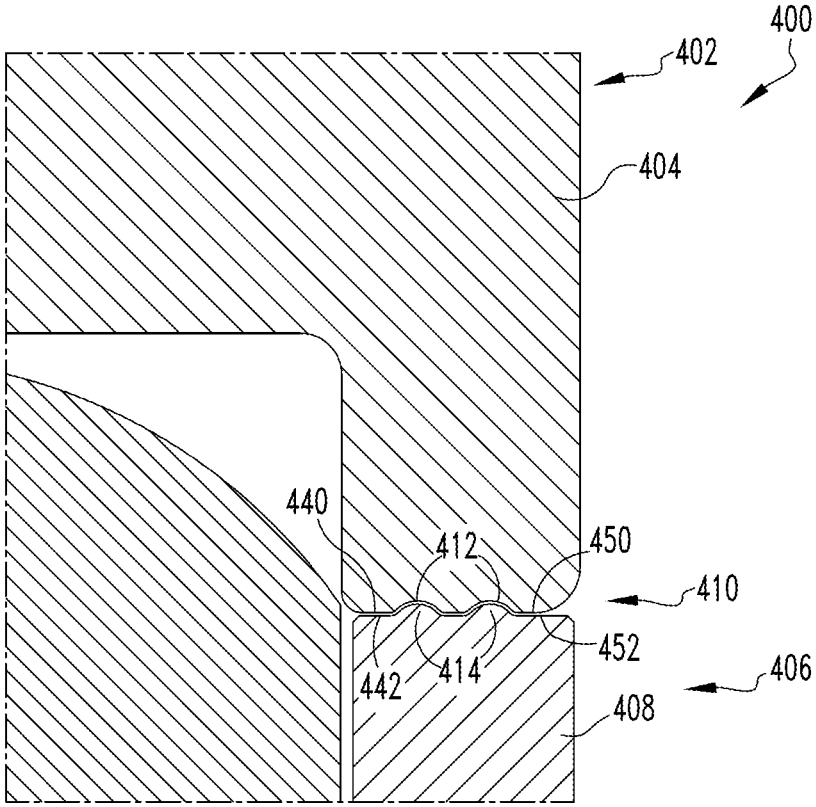
FIG. 15 is an enlarged view of an alternate embodiment of a forming surface including two clamp beads.

In an embodiment that forms a cup 122 and after the cup 122 is formed, the forming punch 404 continues moving downward, pushing the cup 122 lower until the cup 122 contacts a lower pad 408. In the non-limiting embodiment shown and described herein, the forming punch 404 and lower pad 408 have elements that form a "clamp bead" 410. That is, as used herein, the cooperative elements of the tooling 400 that form the clamp bead in the material are collectively identified by reference number 410. As shown in FIGS. 14 and 15, the lower end of the forming punch 404 and the upper end of the lower pad 408 have a generally planar inner portion 440, 442, respectively, and a generally planar outer portion 450, 452. The forming punch 404 outermost portion is, in an exemplary embodiment, curvilinear. Further, the clamp bead 410 includes a number of recesses 412 (hereinafter "clamp bead recess" 412) on the lower end of the forming punch 404, i.e., on the upper tool assembly 402, and, a number of upwardly extending projections 414 (hereinafter "clamp bead projection" 414) on the upper end of the lower pad 408, i.e., on the lower tool assembly 406. Each clamp bead recess 412 has a shape, size and contour that substantially corresponds to the shape, size and contour of an associated clamp bead projection 414. That is, each clamp bead recess 412 is disposed between the forming punch inner portion 440 and forming punch outer portion 450. Similarly, each clamp bead projection 414 is disposed between the lower pad inner portion 442 and lower pad outer portion 452. Further, each clamp bead recess 412 is aligned with an associated clamp bead projection 414 so that when the upper tool assembly 402 is in the second position, each clamp bead projection 414 is disposed substantially within the associated clamp bead recess 412. In one exemplary embodiment, there is a single clamp bead 410, as shown in FIG. 14. In another exemplary embodiment, there are two clamp beads 410, as shown in FIG. 15. These examples are non-limiting and there may be any number of clamp beads 410. The clamp bead 410 facilitates holding the material substantially stationary, for example, by crimping it and locking the material just inboard of the cup sidewall 124, as discussed above.

Accordingly, it will be appreciated that the disclosed concept differs substantially from conventional container bottom forming (e.g., without limitation, doming) methods and apparatus. That is, while the side portions of the cup or container in a traditional forming process might be clamped, relatively little pressure is applied so that movement (e.g., sliding; flowing) of the material into the bottom portion of the cup or container is promoted. In other words, traditionally clamping and stretching the material in the bottom portion of the container was expressly avoided, so as to maintain the thickness of the material in the bottom portion.

Once the peripheral material is suitably clamped (e.g., secured in a substantially fixed position), the forming punch 404 continues to move downward, forcing the material in the cup bottom portion 128 to be forced into the contour 316 (in a manner similar to that shown in FIGS. 6-7) of the tooling 400 causing the material to form a clamp bead 420 (the reference number 420 identifies the "clamp bead" in the material or cup) and to stretch the material into a contoured shape 430, hereinafter the "dome" 430, thereby thinning the material. That is, a non-limiting example of a cup 422 which has been formed in accordance with the process including a clamp bead 420 is shown in FIGS. 16A-16D. It will be appreciated, for example with reference to FIG. 16D, that the material in the dome 430 can be stretched and, therefore, thinned by up to about 0.001 inch, or more. It will also be appreciated that while the contoured shape in the example shown and described herein is a dome 430, that any other known or suitable alternative shapes could be formed without departing from the scope of the disclosed concept. As before, the stretched material of the dome 430 is also advantageously substantially uniform in thickness at various locations and in various directions relative to the grain, as described above.

Figures 17, 17A:
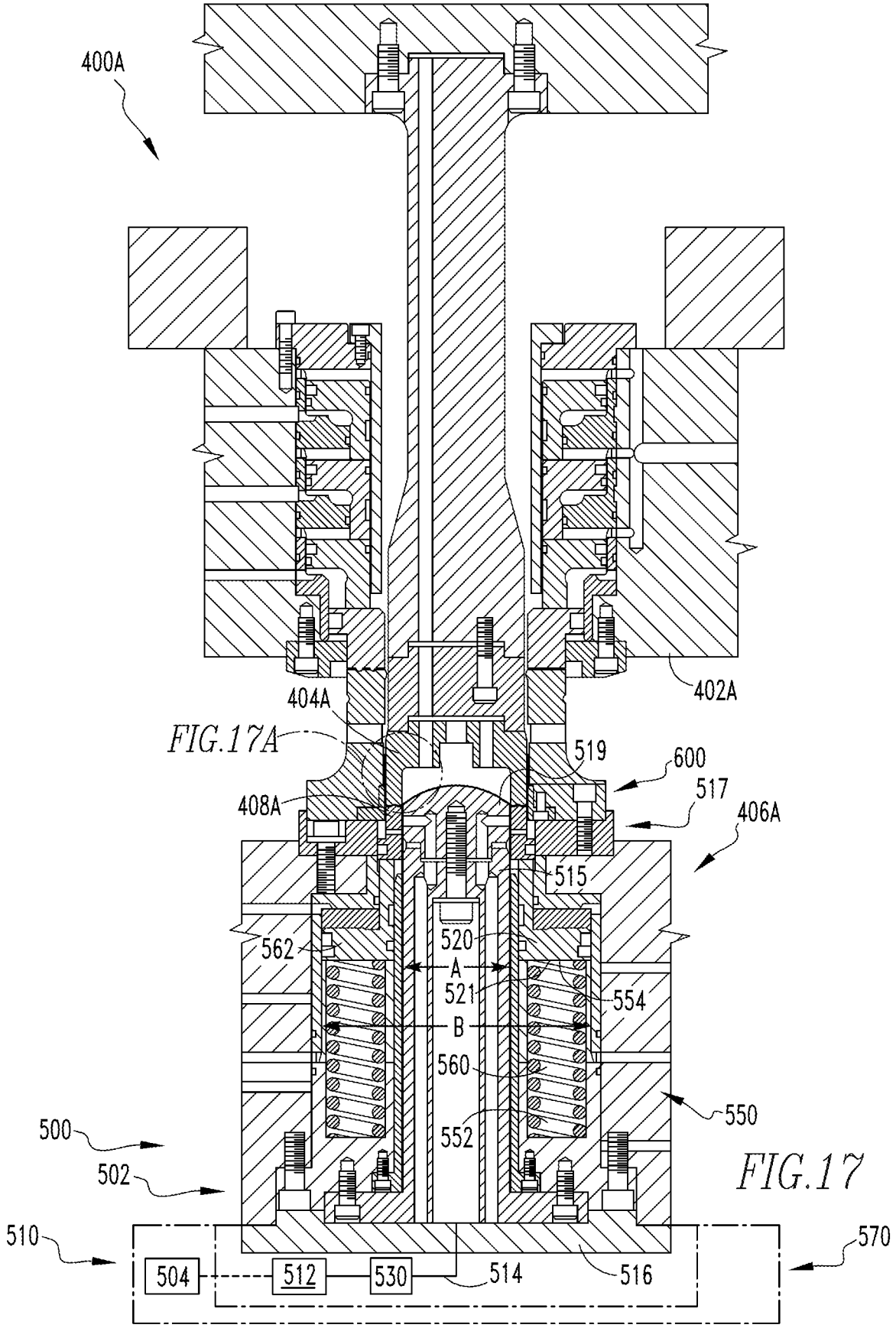
FIG. 17 is a side elevation section view of tooling in accordance with another embodiment of the disclosed concept including a hybrid bias generating assembly.
FIG. 17A is a detailed side view of a progressive clamp bead.
Figure 17A:
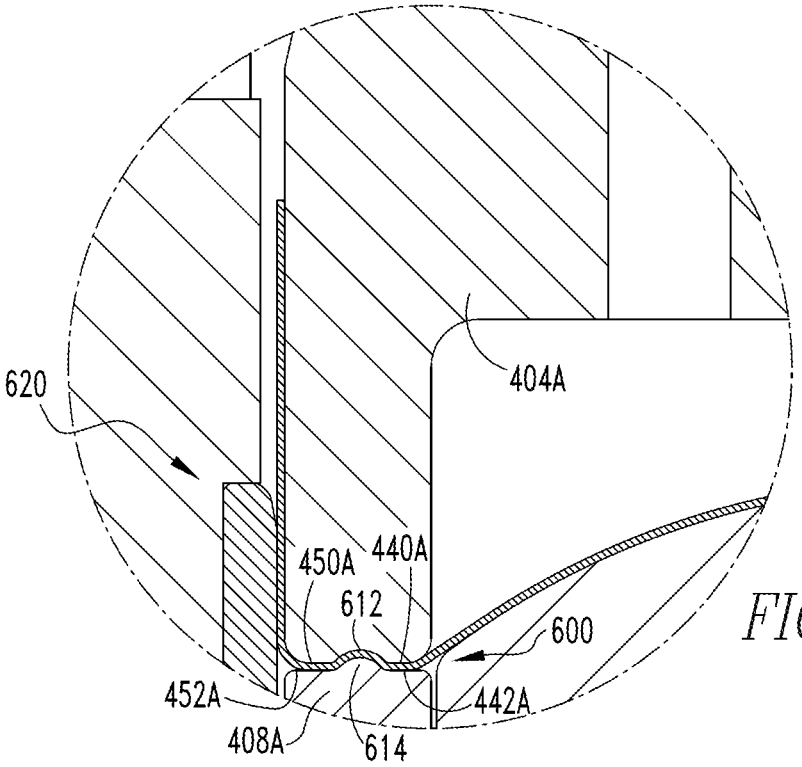

As noted above, the material is clamped (e.g., secured in a substantially fixed position) so as not to permit the material to move (e.g., slide) or flow, and to instead be stretched in a subsequent forming step; the amount of force (e.g., pressure) that is necessary to apply such a clamping effect, is preferably minimized, and, pressure to secure the sidewalls 124, 126 of the cup 122 or container body 22 (FIG. 2), or locations proximate thereto, can be provided pneumatically, as generally shown in FIG. 3, or by a predetermined number of biasing elements (e.g., without limitation, springs 312, 314), as shown in FIGS. 4-7, or by any other known or suitable holding means (e.g., without limitation, hydraulic force) or mechanism (not shown). As shown in FIGS. 17 and 17A, in another exemplary embodiment, the tooling 400A includes features, constructs and assemblies that are structured to progressively clamp the sidewalls 124, 126 (424, 426) of the cup 122 (422) or container body 22 via a hybrid bias generating assembly 500, shown in FIG. 17, and a progressive clamp bead 600, shown in FIG. 17A.

That is, in another embodiment, wherein the elements are substantially similar to the tooling 400 described above, the tooling 400 is structured to progressively clamp the material while progressively stretching the material in the contoured shape 430. In this embodiment, the tooling 400A creates a progressive clamp bead 620, as defined above, in the material. In an exemplary embodiment, the tooling 400A structured to progressively clamp the material utilizes a hybrid bias generating assembly 500. That is, in this embodiment, pressure to secure the sidewalls 124, 126 (424, 426) of the cup 122 (422) or container body 22 (FIG. 2), or locations proximate thereto, are provided by the hybrid bias generating assembly 500. In one embodiment, the pneumatic elements and springs 312, 314, shown in FIGS. 3 and 4, are incorporated into the hybrid bias generating assembly 500. As employed herein, a "hybrid bias generating assembly" is an assembly that generates a bias in at least two different manners, and, the bias is applied to the same component. That is, as employed herein, a "hybrid bias generating assembly" includes at least two bias generating assemblies that apply bias to the same component. A "hybrid bias generating assembly" also includes a number of hybrid components. Thus, an assembly, such as, but not limited to the hybrid bias generating assembly 500 described herein, which generates a bias via a compressed fluid (pressure bias) and via a spring (mechanical bias) satisfies the first requirement of being an active hybrid bias generating assembly. Conversely, a device with a high pressure compressor and a low pressure compressor (both producing pressure bias) is not a "hybrid bias generating assembly" because the manner of producing bias is the same. Further, an assembly wherein one type of bias is applied to one component and another type of bias is applied to a different component is also not a "hybrid bias generating assembly" because the bias is not applied to the same component.

Further, as employed herein, an "active hybrid bias generating assembly" is an assembly that includes at least two bias generating assemblies that apply bias to the same component at the same time. Further, as employed herein, a "selectable hybrid bias generating assembly" is an assembly that includes at least two bias generating assemblies, and, the bias is selectively applied to the same component. That is, a "selectable hybrid bias generating assembly" has the capability of applying bias in at least two different manners and the user determines which bias generating assembly, or both, apply bias to a component. Thus, when a user selects two manners of applying bias, the "selectable hybrid bias generating assembly" operates as an "active hybrid bias generating assembly." Stated alternately, an "active hybrid bias generating assembly" is a type of "selectable hybrid bias generating assembly" but the opposite is not always true. That is, not all "selectable hybrid bias generating assemblies" are "active hybrid bias generating assemblies." A "selectable hybrid bias generating assembly" that applies bias in only one of several available manners is a "selectable hybrid bias generating assembly" but not an "active hybrid bias generating assembly." In an exemplary embodiment, the hybrid bias generating assembly 500 is one of an active hybrid bias generating assembly 502 or a selectable hybrid bias generating assembly 504. As shown schematically, while including the elements of the active hybrid bias generating assembly 502, the selectable hybrid bias generating assembly 504 is associated with additional controls for the pressure generating assembly 510 (discussed below).

The hybrid bias generating assembly 500 includes a pressure generating assembly 510 (shown schematically), a mechanical bias assembly 550, and a number of hybrid components 570. As employed herein, "hybrid components" 570 are components that are structured to be utilized by both bias generating assemblies, in the exemplary embodiment, the pressure generating assembly 510 and the mechanical bias assembly 550. The pressure generating assembly 510, which is part of the lower tool assembly 406A, includes a pressure generating device 512 (shown schematically), a pressure communication assembly 514 (shown schematically), a pressure chamber 516, and a riser assembly 515. The pressure generating device 512 is any known device structured to compress a fluid, or store compressed fluid, at an increased pressure, such as, but not limited to a fluid pump or compressor. The pressure communication assembly 514 includes any number of hoses, conduits, passages or any other construct capable of communicating a pressurized fluid. It is understood the pressure communication assembly 514 also includes seals, valves or any other construct required to control the communication of a pressurized fluid.

In an exemplary embodiment, the lower tool assembly 406 includes a pressure chamber 516 and a riser assembly 515. That is, the lower tool assembly 406 defines the pressure chamber 516. The riser assembly 515 is movably and sealingly disposed in the pressure chamber 516. The riser assembly 515 is further sealed against, and coupled, and/or operatively coupled, to the lower pad 408 and/or a dome support assembly 517 (including a domed member 519) that defines tool contour 316. In this configuration, lower pad 408 and riser assembly 515 move between an upper, first position, and a lower, second position. Further, lower pad 308, 308' is maintained in the first position, at least in part, by the pressurized fluid in pressure chamber 516. That is, when pressure chamber 516 is pressurized, lower pad 408 and riser assembly 515 move to the upper, first position. To move toward the second position, the punch 304 must overcome the bias created by the pressurized fluid in pressure chamber 516.

That is, in an exemplary embodiment, the riser assembly 515 is sealingly and movably coupled, directly coupled to the inner surface of the pressure chamber 516 defined by the lower tool assembly 306. It is understood that the pressure chamber 516 includes a number of seals, not identified, required to prevent fluid from escaping.

The riser assembly 515 includes a torus-shaped body 520 and, in an exemplary embodiment, a spring seat 554, as discussed below. In another embodiment, the riser assembly 515 and the spring seat 554 are a unitary body. If the riser assembly 515 is disposed in the pressure chamber 516, it is understood that the spring seat 554 is also the pressure surface 521 (described below). Thus, the outer radial surface of the riser assembly 515, and the spring seat 554 if included, are sealingly coupled to the inner surface of the pressure chamber 516.

The pressure generating device 512 is in fluid communication, via the pressure communication assembly 514, with the pressure chamber 516. The fluid, and therefore the pressure associated therewith, is communicated to the lower side of the riser assembly 515 (as shown), which is hereinafter identified as the "pressure surface" 521. It is understood that, in an embodiment with a spring seat 554, the pressure surface 521 may be the lower surface of the spring seat 554. Further, it is understood that any area of the pressure surface 521 in contact with a spring 560 (discussed below) does not have pressure acting thereon. Thus, the pressure generating device 512 is structured to control the position of the riser assembly 515 in the pressure chamber 516, and is structured to move the riser assembly 515 in the pressure chamber 516.

In this configuration, the lower pad 408 is a "hybrid component" 570 as defined herein. That is, the lower pad 408 is structured to be utilized by both the pressure generating assembly 510 and the mechanical bias assembly 550. It is noted that a lower pad 408 associated exclusively with a pressure generating assembly 510 or exclusively with a mechanical bias assembly 550 cannot be a "hybrid component" as defined herein. That is, by definition, a lower pad 408 associated exclusively with a pressure generating assembly 510 cannot be "structured to" be utilized by both bias generating assemblies. Similarly, by definition, a lower pad 408 associated exclusively with a mechanical bias assembly 550 cannot be "structured to" be utilized by both bias generating assemblies. Accordingly, a lower pad 408 associated exclusively with a pressure generating assembly 510 or exclusively with a mechanical bias assembly 550 is not a "hybrid component" as employed herein.

In an exemplary embodiment, the mechanical bias assembly 550 includes a number of spring assemblies 552 (which include springs 312, 314) and a number of spring seats 554. A spring assembly 552 includes a number of springs 560 associated with each spring seat 554. In one embodiment, each spring assembly 552 includes a single, linear spring rate compression spring 560. In this embodiment, the mechanical bias assembly 550 is structured to, and does, apply a bias at a generally linear rate during the compression of the spring assemblies 552.

In another exemplary embodiment, each spring assembly 552 includes a number of springs 560 that have a variable spring rate. (It is understood that reference number 560 represents a "spring" rather than a specific type of spring.) The variable spring rate may be any of a progressive spring rate, a degressive spring rate, or a dual rate (sometime identified as "progressive with knee") spring rate. As employed herein, a "progressive spring rate" is a spring rate that increases in compression in a non-linear manner. As employed herein, a "degressive spring rate" is a spring rate that decreases in compression in a non-linear manner. As employed herein, a "dual rate" spring rate is a spring rate that increases at a first linear, or generally linear, spring rate until a selected compression is achieved and thereafter the spring rate increases at a different second linear, or generally linear, spring rate. That is, the first and second spring rates are substantially different from each other. Variable rate springs include, but are not limited to, cylindrical springs with a variable pitch rate, conical springs, and mini block springs.

In one exemplary embodiment, all spring assemblies 552 include substantially the same type of spring 560. That is, for example, each spring assembly 552 includes a number of substantially similar linear spring rate compression springs 560, or, a number of substantially similar dual rate compression springs 560. In another exemplary embodiment, the spring assemblies 552 include different types of springs. For example, within the mechanical bias assembly 550, one set of spring assemblies 552 include a number of substantially similar linear spring rate compression springs 560, and, a second set includes a number of substantially similar dual rate compression springs 560. In another exemplary embodiment, the variable rate spring assemblies 552 may include any of a number of dual rate springs, a plurality of springs with different compression rates, a number of progressive springs, a number of degressive springs, or a combination of any of these.

In an exemplary embodiment, compression springs 560 are disposed in the pressure chamber 516. In this embodiment, at least an upper spring seat 554 is a torus-shaped body 562 that corresponds to the pressure chamber 516 and the dome support assembly 517. The upper spring seat 554 is coupled, directly coupled, fixed, or unitary with, the upper side of the riser assembly 515. The compression springs 560 are sized to be in compression when disposed in the pressure chamber 516. In this configuration, the mechanical bias assembly 550 biases, i.e., operatively engages, the lower pad 308, 308'. That is, the lower pad 308, 308' is biased to its first position by the mechanical bias assembly 550.

The total bias/force generated by the hybrid bias generating assembly 500 can also be expressed as a "total bias pressure." As employed herein, the "total bias pressure" means the total bias/pressure generated by the hybrid bias generating assembly 500. Further, the mechanical bias assembly 550 creates a force which, as employed herein, is considered to be evenly distributed over the pressure surface 521. That is, the mechanical force may be treated as a pressure for purposes of calculating the forces and pressure acting on the components. In an exemplary embodiment, the mechanical bias assembly 550 generates between about 70%-80%, or about 75%, of the total bias pressure. Conversely, the pressure generating assembly 510 generates between about 20%-30%, or about 25%, of the total bias pressure. The force/pressure generated by the pressure generating device 512 acts upon the pressure surface 521. Further, in an exemplary embodiment, the pressure generating assembly 510 is structured to pressurize the pressure chamber 516 at a generally constant pressure. In another exemplary embodiment, the mechanical bias assembly 550 generates between about 70%-80%, or about 75%, of the total bias pressure. Conversely, the pressure generating assembly 510 generates between about 20%-30%, or about 25%, of the total bias pressure.

In an alternate exemplary embodiment, the hybrid bias generating assembly 500 is structured to have substantially all, or all, of the total bias pressure generated by the mechanical bias assembly 550 with the pressure generating assembly 510 generating a generally constant, but generally minimal pressure. That is, in this embodiment, the mechanical bias assembly 550 generates between about 90%-99%, or about 95%, of the total bias pressure. Conversely, the pressure generating assembly 510 generates between about 1%-10%, or about 5%, of the total bias pressure. Further, the pressure generating assembly 510 is structured to pressurize the pressure chamber 516 at a generally constant pressure. In this embodiment, the hybrid bias generating assembly 500 is an active hybrid bias generating assembly 502.

Further, in this embodiment, the hybrid bias generating assembly 500 is structured to alter the ratio of force generated by the mechanical bias assembly 550 and the pressure generating assembly 510. That is, for example, during an initial clamping operation, the total bias pressure is substantially generated by the mechanical bias assembly 550, i.e., the mechanical bias assembly 550 generates between about 90%-100%, or about 99%, of the total bias pressure, and, the pressure generating assembly 510 generates between about 0%-10%, or about 5%, of the total bias pressure. After the initial clamping operation, i.e., during a secondary clamping operation, the total bias pressure generated by the mechanical bias assembly 550 is reduced to be greater than, or equal to, 75% of the total bias pressure while the pressure generating assembly 510 generates up to 25%, of the total bias pressure.

In an alternative embodiment, the hybrid bias generating assembly 500 is a selectable hybrid bias generating assembly 504 wherein the user selects the source that generates the pressure, i.e., either the mechanical bias assembly 550 or the pressure generating assembly 510. For example, in a selectable hybrid bias generating assembly 504, a pressure control assembly 530 (discussed below), is structured to provide a selectable pressure so as to meet the ratio of mechanical bias to pressure bias, as discussed below. In this embodiment, the mechanical bias assembly 550 generates between about 99%-100%, or substantially all of the total bias pressure. Conversely, the pressure generating assembly 510 generates between about 0%-1%, or a negligible percentage of the total bias pressure. That is, for example, the pressure generating assembly 510 generates a negligible percentage of the total bias pressure while generating enough pressure to bias elements of the lower tool assembly 306 upwardly during the upstroke. As before, the pressure generating assembly 510 is, in an exemplary embodiment, structured to pressurize the pressure chamber 516 at a generally constant pressure.

In another embodiment, not shown, the pressure generating assembly 510 includes a number of stacked pistons (similar to what is shown in FIG. 3) as well as a selectable pressure control assembly. The selectable pressure control assembly is structured to generate a selected pressure profile. The selected pressure profile is, in an exemplary embodiment, a profile wherein the pressure increases in a manner that is similar to a progressive spring rate, described above.

In another embodiment, the hybrid bias generating assembly 500 is again a selectable hybrid bias generating assembly 504 wherein the user selects the source that generates the pressure, i.e., either the mechanical bias assembly 550 or the pressure generating assembly 510. In this embodiment, however, the pressure generating assembly 510 generates between about 99%-100%, or substantially all of the total bias pressure. Conversely, the mechanical bias assembly 550 generates between about 0%-1%, or a negligible percentage of the total bias pressure. That is, for example, the mechanical bias assembly 550 generates a negligible percentage of the total bias pressure while generating enough pressure to bias elements of the lower tool assembly 306 upwardly during the upstroke. As before, the pressure generating assembly 510 is, in an exemplary embodiment, structured to pressurize the pressure chamber 516 at a generally constant pressure.

In this embodiment, the pressure generating assembly 510 is structured to apply a variable pressure. That is, the pressure generating assembly 510 includes a pressure control assembly 530 (shown schematically) that is structured to vary the pressure within the pressure chamber 516. The pressure control assembly 530 in an exemplary embodiment, includes a number of pressure sensors (not shown) in the pressure chamber 516 as well as a position sensor (not shown) structured to determine the position of the riser assembly 515. The pressure control assembly 530 is structured to alter the pressure within the pressure chamber 516 according to a pressure profile. That is, the pressure control assembly 530 is structured to increase or decrease the pressure within the pressure chamber 516 depending upon the position of the riser assembly 515. In an exemplary embodiment, the pressure control assembly 530 includes a programmable logic circuit (PLC) (not shown) and a number of electronic pressure regulators. The sensors and electronic pressure regulators are coupled to, and in electronic communication with, the PLC. The PLC further includes instructions for operating the electronic pressure regulators as well as data representing the pressure profile.

In an exemplary embodiment, the hybrid bias generating assembly 500 is structured to be switchable between an active hybrid bias generating assembly 502 or a selectable hybrid bias generating assembly 504, or switchable between different configurations of either an active hybrid bias generating assembly 502 or a selectable hybrid bias generating assembly 504, by virtue of removable spring assemblies 552. That is, the spring assemblies 552 are removably coupled to the spring seats 554 within the pressure chamber 516.

It is noted that, in another embodiment, the upper tool assembly 302 does not include a hybrid bias generating assembly 500, but rather one of a mechanical bias assembly 550 or a pressure generating assembly 510 wherein the selected assembly provides 100% of the total bias pressure. The mechanical bias assembly 550 or the pressure generating assembly 510 is coupled to a "progressive clamp bead" 600 as discussed below. That is, the mechanical bias assembly 550 or the pressure generating assembly 510 is coupled to the other elements described herein.

That is, the tooling 400 as described above, when combined with a hybrid bias generating assembly 500, is structured to create a progressive clamp bead 620 in the material or cup 122, 422. Thus, as used herein, the elements of the tooling 400 that define a clamp bead 410 when combined with a hybrid bias generating assembly 500 become elements of a "progressive clamp bead" 600 in the tooling 400A. Other than the elements discussed below, the tooling 400A is substantially similar to the tooling 400 discussed above and like elements will use like reference numbers followed by the letter "A". That is, the following description relates to an embodiment including a number of beads, which, as discussed below, are "progressive clamp beads" 600 in the tooling 400A and which are structured to form "progressive clamp beads" 620 in the material or cup 122, 422. That is, reference number 620 identifies a progressive clamp bead in the material. It is understood that the hybrid bias generating assembly 500 and the progressive clamp bead 600 may also be used in an embodiment including a step bead 310 or the hybrid bias generating assembly may be used in an embodiment without a bead at all. As discussed above, and in an exemplary embodiment, a punch 404A (or "forming punch" 404A) opposes a lower pad 408A. Thus, when the upper tooling assembly 402A moves to the second position, the punch 404A is disposed immediately adjacent the lower pad 408A. In this configuration, the forming punch 404A and the lower pad 408A engage, i.e., progressively clamp, the cup 122.

In an exemplary configuration of any of these embodiments, either the upper tooling 402A and/or the lower tool assembly 406A defines the progressive clamp bead 600. That is, similar to the embodiment above, the progressive clamp bead 600 includes a progressive clamp bead recess 612 in the punch 404A and a progressive clamp bead projection 614 in the lower pad 408A. These elements create a progressive clamp bead in the material by applying a progressive force to the progressive clamp bead 600.

That is, in an exemplary embodiment, the hybrid bias generating assembly 500, and more specifically the mechanical bias assembly 550, initially applies a spring preload force to the blank of material 14. The initial spring preload force is not sufficient to substantially prevent the flow of material through the progressive clamp bead 600. However, as the dome 430 has not yet begun to form, there is, essentially, no material flowing through the progressive clamp bead 600. That is, there is no force that would cause material 14 to flow through the progressive clamp bead 600. In fact, the initial spring preload force is not sufficient to form the progressive clamp bead 620 in the material 14.

Following the application of the initial spring preload force, the hybrid bias generating assembly 500, and more specifically the pressure generating assembly 510, increases the force on the material 14 and sets, i.e., forms, the progressive clamp bead 600 in the material 14. Because the force has increased, the amount of material 14 that can flow through the progressive clamp bead 600 is reduced relative to the amount that flows during the initial spring preload force. As before, however, the dome 430 has not yet begun to form and there is, essentially, no material flowing through the progressive clamp bead 600.

When the punch 404 continues to move downward, the material in the cup bottom portion 128 is forced into the contour 316 of the tools 400A causing the material 14 to stretch into the contoured shape 430. At this time in the forming process, the force on the material continues to progressively increase due to forces generated by the mechanical bias assembly 550. That is, in an exemplary embodiment, the springs 560 have a variable spring rate which is a progressive spring rate. As the force on the material continues to progressively increase, the amount of material that flows through the progressive clamp bead 600 is reduced to a negligible amount.

It is noted that without the use of a clamp bead 410 or a progressive clamp bead 600, and to form a cup with a dome as discussed in relation to FIG. 12, a traditional press would need to apply a pressure of about 23,000 lbf. to 25,000 lbf. per pocket. Thus, the number of pockets would be limited to about 6, or, if more pockets were used there would be excessive counter forces acting on the press. Further, experimentation has shown that a cup dome made with such tooling is unacceptably uneven. The use of a clamp bead 410 or a progressive clamp bead 600 allows the tooling 400, 400A to operate with a "reduced force." That is, as employed herein, a "reduced force" acting on a tooling 400A means that the force acting on a tooling 400A required to form the material by stretching or progressively stretching is reduced between about 10% to 50%, when compared to the force required to form material into a cup (or a cup with a bead using tooling with a common bead). Further, in an exemplary embodiment, the "reduced force" is about 46% for a steel cup, or about 53% for aluminum, when compared to the force required to form material into a cup (or a cup with a bead using tooling with a common bead). Further, to operate with a "reduced force," as used herein, the tooling must include a clamp bead 410 or a progressive clamp bead 600, as defined herein. Further, as used herein, to operate with a "reduced force" the tooling must be specifically described as, and/or shown to be, operating with a force between about 10% to 50%, or about 30%, of the force required to form material into a cup (or a cup with a bead using tooling with a common bead). Thus, tooling with a common bead that is, ostensibly, "capable" of operating with a force between about 10% to 50%, or about 30%, of the force required to form material into a similar shape does not operate with a "reduced force" as defined herein. Further, the term "reduced force" may be modified by the term "moderately" which means the force acting on a tooling 400A required to form the material by stretching or progressively stretching is reduced between about 1% to 65%, when compared to the force required to form material into a cup (or a cup with a bead using tooling with a common bead).

Figure 19A:
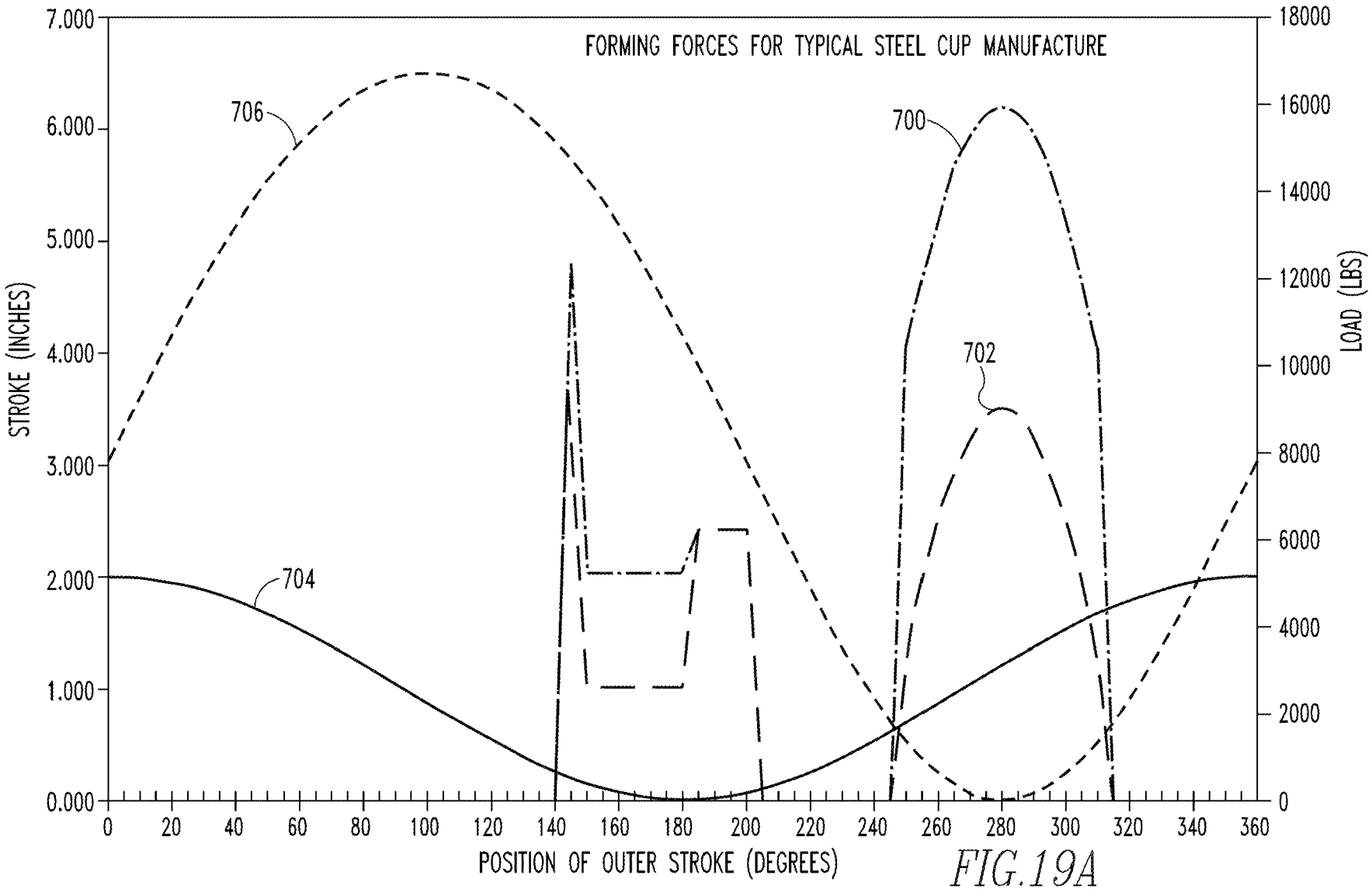
FIG. 19A is a chart showing exemplary reduced forces when forming a steel cup relative to an example of the prior art.
Figure 19B:
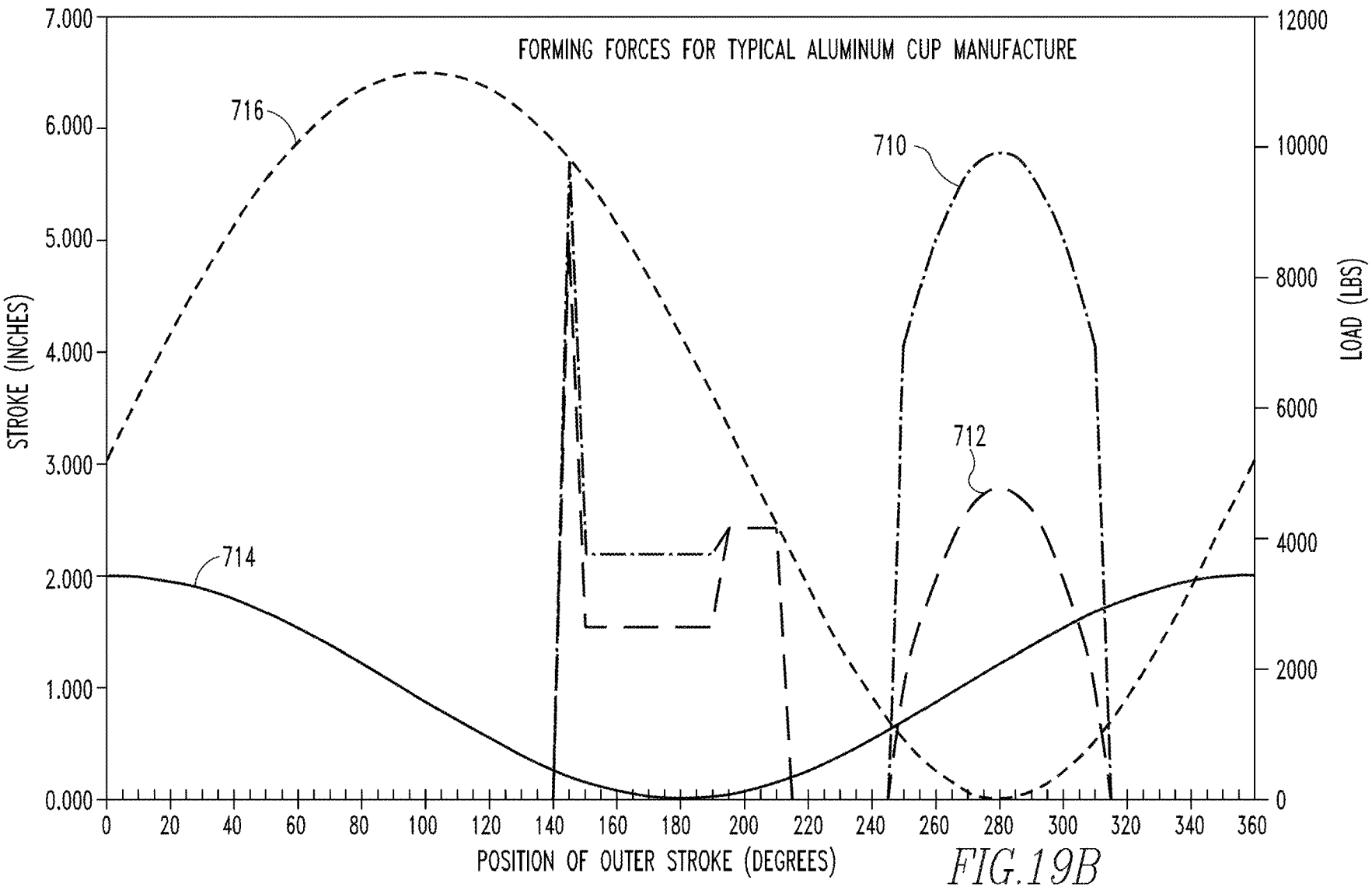
FIG. 19B is a chart showing exemplary reduced forces when forming an aluminum cup relative to an example of the prior art.

That is, the load required to form a shell or cup limits the number of constructs formed at one time. As is known, the tooling 400, 400A is coupled to, and driven by, a press (not shown). The following example demonstrates the use of a clamp bead 410 or a progressive clamp bead 600 that allows the tooling 400, 400A to operate with a "reduced force" or a "moderately reduced force." That is, the forces associated with traditional tooling compared to tooling 400, 400A including a clamp bead 410 or a progressive clamp bead 600 are shown in FIGS. 19A and 19B; that is, in FIG. 19A, which discloses the loads and tooling position with respect to position of stroke (defined below) and in relation to forming steel. Line 700 represents loads associated with a prior art tooling, line 702 represents reduced forces associated with tooling 400A (and a progressive clamp bead), line 704 represents the position of the outer slide, reduced force and line 706 represents the position of the punch 404A. The position of the outer slide and punch 404A is measured relative to an arbitrary position on the tooling 400, 400A and, in this example, the lowest position is identified as zero inches. FIG. 19B relates to the forming of aluminum and includes similar lines 710 (prior art load), 712 (reduced force), 714 (outer slide position) and 716 (punch 404A position).

Figure 20:
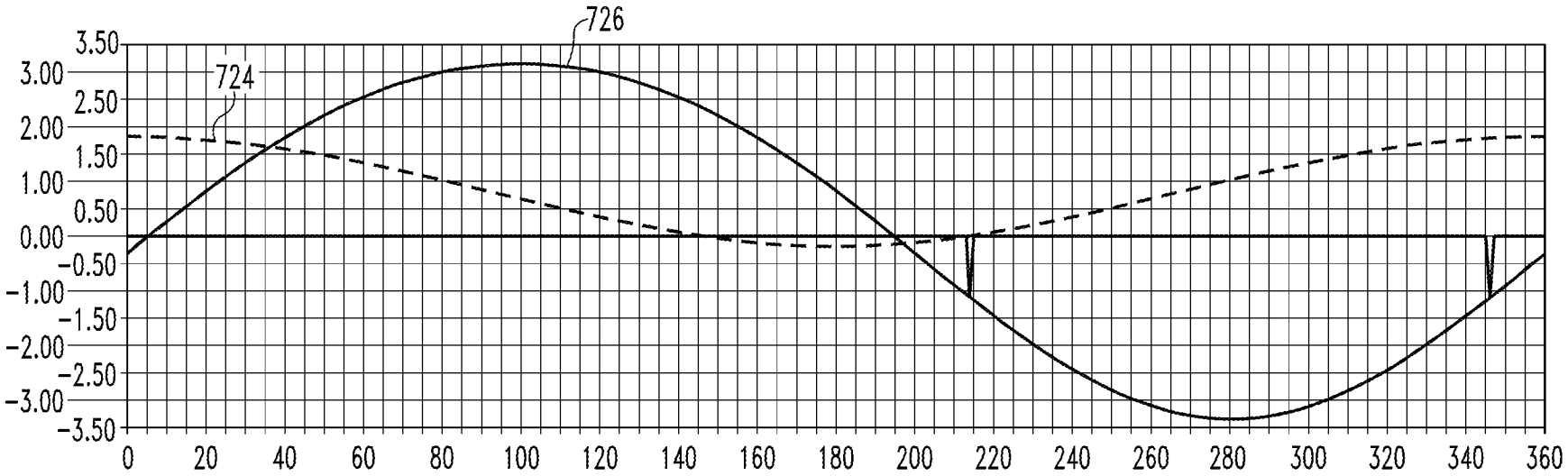
FIG. 20 is a chart showing outer slide and punch positions relative to position of stroke as well as associated prior art loads and reduced forces.
Figure 21:
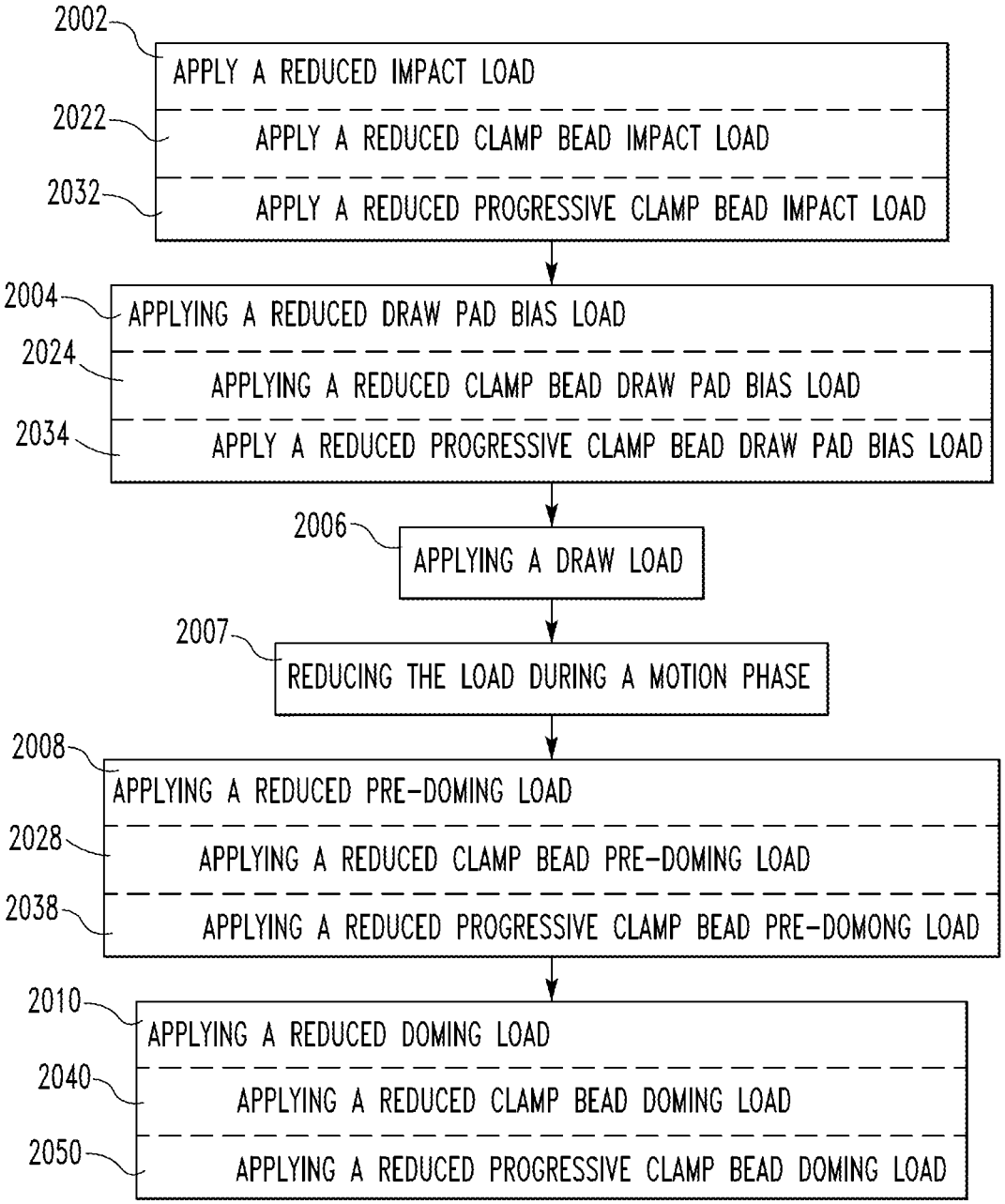
FIG. 21 is a flowchart showing another disclosed method.

FIG. 20 also shows the position of the outer slide and punch 404A, lines 724, 726, respectively, relative to an arbitrary position on the tooling 400, 400A and, in this example, the lowest position is identified as −3.5 inches. Further, in an exemplary embodiment, the loads and reduced forces relative to position of stroke are shown in the table below.

a time. That is, each formed product is formed within a "pocket," as used herein, on the press assembly. That is, each such forming construct is identified as a "pocket" on the press. Thus, for example, if the maximum force required to form a shell, as described above, was eighteen thousand lbf, then a one hundred fifty ton press could include eight pockets. As is known, a press structured to form steel shells typically includes 8-9 pockets, depending upon characteristics of the shell; that is some shells require less than the exemplary eighteen thousand lbf for formation. Further, in an embodiment discussed below, a one hundred fifty ton press structured to form aluminum shells typically includes 14-15 pockets. Thus, the existing tooling(s) are limited to the number of constructs formed by the existing presses. This is a disadvantage as the presses and associated tooling(s) have a limited efficiency in that a limited number of shells/cups are formed at one time.

| | 145 | 150 | 155 | 160 | 165 | 170 | 175 | 180 | 185 | 190 | 195 | 200 | 205 | 210 |
|---|---|---|---|---|---|---|---|---|---|---|---|---|---|---|
| Upper piston @ 60 psi | 4500 | 4500 | 4500 | 4500 | 4500 | 4500 | 4500 | 4500 | 4500 | 4500 | 4500 | 4500 | 4500 | 4500 |
| Upper piston @30 psi | 2250 | 2250 | 2250 | 2250 | 2250 | 2250 | 2250 | 2250 | 2250 | 2250 | 2250 | 2250 | 2250 | 2250 |
| Blanking | 6152 | | | | | | | | | | | | | |
| Forming | | | | | | | | | | | 4920 | 4920 | 4920 | 4920 |
| Lower springs | | | | | | | | | | | | | | |
| Total (Current loads) lbs | 10,652 | 4,500 | 4,500 | 4,500 | 4,500 | 4,500 | 4,500 | 4,500 | 4,500 | 4,500 | 9,420 | 9,420 | 9,420 | 9,420 |
| Total (Reduced forces) lbs | 8,402 | 2,250 | 2,250 | 2,250 | 2,250 | 2,250 | 2,250 | 2,250 | 2,250 | 2,250 | 7,170 | 7,170 | 7,170 | 7,170 |
| Outer Load (current) | 10,652 | 4,500 | 4,500 | 4,500 | 4,500 | 4,500 | 4,500 | 4,500 | 4,500 | 4,500 | 4,500 | 4,500 | 4,500 | 4,500 |
| Outer Load (reduced) | 8,402 | 2,250 | 2,250 | 2,250 | 2,250 | 2,250 | 2,250 | 2,250 | 2,250 | 2,250 | 2,250 | 2,250 | 2,250 | 2,250 |
| Inner Load (current) | 0 | 0 | 0 | 0 | 0 | 0 | 0 | 0 | 0 | 0 | 4,920 | 4,920 | 4,920 | 4,920 |
| Inner Load (reduced) | 0 | 0 | 0 | 0 | 0 | 0 | 0 | 0 | 0 | 0 | 4,920 | 4,920 | 4,920 | 4,920 |

| | 245 | 250 | 255 | 260 | 265 | 270 | 275 | 280 | 285 | 290 | 295 | 300 | 305 | 310 |
|---|---|---|---|---|---|---|---|---|---|---|---|---|---|---|
| Upper piston @ 60 psi | | | | | | | | | | | | | | |
| Upper piston @ 30 psi | | | | | | | | | | | | | | |
| Lower piston @ 400 psi | 11,246 | 11,246 | 11,246 | 11,246 | 11,246 | 11,246 | 11,246 | 11,246 | 11,246 | 11,246 | 11,246 | 11,246 | 11,246 | |
| Blanking | | | | | | | | | | | | | | |
| Forming | | | | | | | | | | | | | | |
| Lower springs | 213.6 | 881 | 1437 | 1877 | 2195 | 2387 | 2451 | 2387 | 2195 | 1877 | 1437 | 881 | 214 | |
| Total (Current loads) lbs | 11,460 | 12,127 | 12,683 | 13,123 | 13,441 | 13,633 | 13,697 | 13,633 | 13,441 | 13,123 | 12,683 | 12,127 | 11,460 | |
| Total (Reduced forces) lbs | 214 | 881 | 1,437 | 1,877 | 2,195 | 2,387 | 2,451 | 2,387 | 2,195 | 1,877 | 1,437 | 881 | 214 | |
| Outer Load (current) | 0 | 0 | 0 | 0 | 0 | 0 | 0 | 0 | 0 | 0 | 0 | 0 | 0 | |
| Outer Load (reduced) | 0 | 0 | 0 | 0 | 0 | 0 | 0 | 0 | 0 | 0 | 0 | 0 | 0 | |
| Inner Load (current) | 11,460 | 12,127 | 12,683 | 13,123 | 13,441 | 13,633 | 13,697 | 13,633 | 13,441 | 13,123 | 12,683 | 12,127 | 11,460 | |
| Inner Load (reduced) | 214 | 881 | 1,437 | 1,877 | 2,195 | 2,387 | 2,451 | 2,387 | 2,195 | 1,877 | 1,437 | 881 | 214 | |

It is understood that, in this exemplary embodiment, the press is assumed to be a one-hundred and fifty ton dual-action press with a 75 ton (150,000 lbf) capacity for each of the upper and lower tooling and with 15 pockets forming steel. That is, the loads shown are the loads for each pocket. It is further understood that between position of stroke 215° and 240° (between the drawing of the cup and dome formation) the inner and outer loads are 0.0 lbf.

Further, the prior art press is forming steel cups and, due to the higher forces (15,940 lbf), is limited to eight cups at Further, it is understood that the following discussion relates to forming the dome 430. FIGS. 19A and 19B also show reduced forces (and moderately reduced forces) are related to the movement of the outer slide and associated with a pressure concentrating forming surface, as disclosed in U.S. patent application Ser. No. 14/722,187, filed May 27, 2015, Pub. No. 2015/025137 (Sep. 10, 2015) entitled, CONTAINER, AND SELECTIVELY FORMED SHELL, AND TOOLING AND, ASSOCIATED METHOD FOR PROVIDING SAME. The reduced force related to the outer slide are shown to the left of 180° "position of stroke." The reduced force related to the formation of a shell/cup are not, but are not discussed in detail herein.

Before discussing the exemplary embodiment, the following equations and assumptions are noted. Initially, it is noted that forces generated in the press are not typically linear as the press is subject to vibrations and other physical effects; the lines representing the change in forces are shown on FIGS. 19 and 20 as substantially straight or as smooth curves as this is common in the art. Further, the calculated forces and resulting Figures are based on equations known and accepted in the art and include coefficients and other factors determined by experimentation. For example, the near instantaneous force associated with the blanking of the material, at about position of stroke 145°, includes an "Impact Draw Force" that is determined via experimentation and is about 5,250 lbs. for steel and about 3,750 for aluminum, in the present examples. Further, the Blank Force is determined by the equation:

$$\text{Blank_Force}=K*(\text{UTS})*t*L+(\text{Impact_Draw_Pad})$$

$$\text{Blank_Force}=0.7*(\text{UTS})*t*\pi*D+(\text{Impact_Draw_Pad})$$

wherein
L PI*D (Blanking Perimeter)
t gage of blank
K Blanking coefficient (used as % of UTS when shear strength not avail.)
UTS Ultimate Tensile Strength
sheet metal and the total area being sheared along the periphery.

The maximum punch force, F, can be estimated from the equation $$F=0.7TL(\text{UTS}) \quad (16.1)$$

Blank_Force=K*(UTS)*t*L+(Impact_Draw_Pad)
Blank_Force=0.7*(UTS)*t*π*D+(Impact_Draw_Pad)
wherein
L PI*D (Blanking Perimeter)
t gage of blank
K Blanking coefficient (used as % of UTS when shear strength not avail)
UTS Ultimate Tensile Strength
sheet metal and the total area being sheared along the periphery
The maximum punch force, F, can be estimated from the equation $$F=0.7TL(\text{UTS}) \quad (16.1)$$

That is, the Blank Force is the Punch Force and the Impact Draw Force combined.

Further, the drawing force is determined by the equation
d Cup Diameter
D Blank Diameter
Ys Yield Strength
C Friction Constant for Bending $$\text{Drawing_Force}=\pi*d*t*Ys*\left(\frac{D}{d}-C\right)$$

Wherein
d Cup Diameter
D Blank Diameter
t gage of blank
Ys Yield Strength
C Friction Constant for Bending
For steel and aluminum, the constant for friction and bending is 0.6 to 0.7. The drawing coefficient (D/d−C) is determined by experimentation.

As noted above, however, the forces that occur before the doming process are not relevant to the present claims. The forces associated with the doming process are determined by the following equations:

$$\text{Dome_Force}=\text{Spring_Force}+\text{Air_Force}$$

$$\text{Dome_Force}=(K*\Delta X*\#\text{Springs})+(\text{Piston_Area}*\text{Piston_Pressure})$$

$$\text{Dome_Foce}=(K*(\text{Press_Stroke}+\text{Preload})*\#\text{Springs})+((\text{Piston_Area}-\text{Spring_Area}*8)*\text{Piston_Pressure}$$

$$\text{Dome_Force}=(1360*(\text{Press_Stroke}-\text{Preload})*8)+\left(\left(\left(\frac{\pi*6.75^2}{4}\right)-\left(\frac{\pi*3.125^2}{4}\right)\right)-\left(\left(\frac{\pi*1.50^2}{4}\right)-\left(\frac{\pi*0.75^2}{4}\right)\right)*8\right)*\text{Piston_Pressure}$$

$$\text{Dome_Force}=\text{Spring_Force}+\text{Air_Force}$$

That is, the riser assembly torus-shaped body 520 acts as the upper spring seat 554 and corresponds to the pressure chamber 516. The area of the torus-shaped body 520 is determined by subtracting the inner area, determined at diameter "A" in FIG. 17 from the outer area, determined at "B" in FIG. 17. Further, the pressure acts upon the area of the riser assembly torus-shaped body 520 that is not engaged by the eight springs 560. The springs 560, however, also provide a mechanical force as discussed above. In this example, the spring constant is about 1360 and ΔX is the compression of the springs 560 at each position of stroke.

In one exemplary embodiment, the maximum forces associated with forming a 422 steel cup as shown in FIGS. 16A-16D, and with a dome 430 described above is about 15,940 lbf. whereas the "reduced force" when using a clamp bead 410 and/or progressive clamp bead 600 is about 9,034 lbf. The data supporting the forces shown on FIG. 19A are set forth in Appendix 1. On FIG. 19A, the maximum forces are shown at about 280° position of stroke. For this example it is assumed that the exemplary hybrid bias generating assembly 500 has a pressure surface 521 with a total area of about 28.11 $in^2$ (i.e., a torus with an inner diameter of about 3.125 in. and an outer diameter of about 6.75 in.) and eight springs 560. The springs 560 generate a maximum combined force of about 6,735 lbs. Further, the spring seat 554 is also the pressure surface 521, as described above. Thus, the area of the pressure surface 521 upon which pressure acts (i.e., the surface area not in contact with a spring 560) is about 17.5 $in^2$. In this configuration, and with a traditional tooling without a clamp bead 410 or a progressive clamp bead 600, to form a cup 422, as is known, a pressure generating device must provide a pressure of about 400 psi which generates a force of about 9,205 lbs. As noted above, the mechanical bias assembly 550, i.e., springs 560, generates a force of about 6,735 lbs. Thus, the maximum total force acting on the material 14 is about 15,940 lbs. This force creates a reaction force that acts upon the tooling, this non-reduced force is a disadvantage.

In another exemplary embodiment, a tooling 400A that includes a progressive clamp bead 600 allows for the 422 cup with the profile described above to be formed while predominantly utilizing the mechanical bias assembly 550, i.e., springs 560. That is, in an exemplary embodiment, the pressure generating device 512 provides a pressure of about 100 psi which generates a force of about 2,299 lbs. As before, the mechanical bias assembly 550, i.e., springs 560, generates a force of about 6,735 lbs. Thus, the pressure generating device 512 provides about 25% of the total force and the mechanical bias assembly 550 provides about 75% of the total force. Moreover, the maximum total force is about 9,034 lbs. of force, which is about 56% of the 15,940 lbs. of force required relative to the prior art embodiment above. Accordingly, the tooling 400A that includes a progressive clamp bead 600 operates at a "reduced force" relative to the embodiment above.

It is understood that the pressure provided by the pressure generating assembly 510 may be changed. The following table provides a comparison of pressure bias and mechanical bias at selected pressures. For this example, and for purposes of comparison, the prior art system operated at a pressure of about 432 psi which brings the total load to a maximum allowable load per pocket of 16,667 lbf. It is noted that especially desirable results have been observed when the air pressure is one of 290 psi, 195 psi, and 100 psi.

| Force Reduction (%) | Total Force (Air + Spring) | Air Pressure (PSI) | Air Force (Lbs) | Pressure Bias Air % of Total Force | Spring Force (Lbs) | Mechanical Bias Spring % of Total Force |
|---|---|---|---|---|---|---|
| 4% | 15944 | 400 | 9209 | 58% | 6735 | 42% |
| 10% | 15023 | 360 | 8288 | 55% | 6735 | 45% |
| 11% | 14792 | 350 | 8058 | 54% | 6735 | 46% |
| 15% | 14217 | 325 | 7482 | 53% | 6735 | 47% |
| 20% | 13411 | 290 | 6676 | 50% | 6735 | 50% |
| 22% | 13066 | 275 | 6331 | 48% | 6735 | 52% |
| 25% | 12490 | 250 | 5755 | 46% | 6735 | 54% |
| 29% | 11915 | 225 | 5180 | 43% | 6735 | 57% |
| 32% | 11339 | 200 | 4604 | 41% | 6735 | 59% |
| 33% | 11224 | 195 | 4489 | 40% | 6735 | 60% |
| 35% | 10764 | 175 | 4029 | 37% | 6735 | 63% |
| 39% | 10188 | 150 | 3453 | 34% | 6735 | 66% |
| 42% | 9612 | 125 | 2878 | 30% | 6735 | 70% |
| 46% | 9037 | 100 | 2302 | 25% | 6735 | 75% |
| 49% | 8461 | 75 | 1727 | 20% | 6735 | 80% |
| 53% | 7886 | 50 | 1151 | 15% | 6735 | 85% |
| 56% | 7310 | 25 | 576 | 8% | 6735 | 92% |
| 58% | 6965 | 10 | 230 | 3% | 6735 | 97% |
| 59% | 6781 | 2 | 46 | 1% | 6735 | 99% |
| 60% | 6735 | 0 | 0 | 0% | 6735 | 100% |

FIG. 19B discloses a similar reduction in force when forming aluminum. That is, when forming aluminum with the prior art tooling and with a pressure of about 365 psi, the maximum load when forming the dome was about 9,916 lbf per pocket (at position of stroke 280°) as shown on FIG. 19B and as detailed in Appendix 1. In this configuration, a one-hundred and fifty ton dual-action press with a 75 ton (150,000 lbf) capacity for each of the upper and lower tooling had fifteen pockets. Using the tooling 400A described above, and with a pressure of about 70 psi, the maximum load is reduced to about 4,750 lbf. In this embodiment, it is again assumed that the exemplary hybrid bias generating assembly 500 has a pressure surface 521 with a total area of about 28.11 $in^2$ (i.e., a torus with an inner diameter of about 3.125 in. and an outer diameter of about 6.75 in.) and eight springs 560. In this example, the springs 560 generate a maximum combined force of about 3,526 lbs. Thus, in this example, the pressure generating assembly 510 generates a force of about 1,224 lbf. and the mechanical bias assembly 550 generates a force of about 3,526 lbf.

As before, the pressure generated by the pressure generating assembly 510 may be changed. The following table provides a comparison of pressure bias and mechanical bias at selected pressures. For this example, and for purposes of comparison, the total load, which is the maximum allowable load per pocket, was determined to be 10,000 lbf. per pocket. It is noted that especially desirable results have been observed when the air pressure is one of 200 psi, 135 psi, and 68 psi.

| Force Reduction (%) | Total Force (Air + Spring) | Air Pressure (PSI) | Air Force (Lbs) | Pressure Bias Air % of Total Force | Spring Force (Lbs) | Mechanical Bias Spring % of Total Force |
|---|---|---|---|---|---|---|
| | 10000 | | | | | |
| 1% | 9918 | 365 | 6392 | 64% | 3526 | 36% |
| 2% | 9830 | 360 | 6304 | 64% | 3526 | 36% |
| 3% | 9655 | 350 | 6129 | 63% | 3526 | 37% |
| 8% | 9217 | 325 | 5691 | 62% | 3526 | 38% |
| 12% | 8779 | 300 | 5254 | 60% | 3526 | 40% |
| 17% | 8342 | 275 | 4816 | 58% | 3526 | 42% |
| 21% | 7904 | 250 | 4378 | 55% | 3526 | 45% |
| 25% | 7466 | 225 | 3940 | 53% | 3526 | 47% |
| 30% | 7028 | 200 | 3502 | 50% | 3526 | 50% |
| 34% | 6590 | 175 | 3065 | 47% | 3526 | 53% |
| 38% | 6153 | 150 | 2627 | 43% | 3526 | 57% |
| 41% | 5890 | 135 | 2364 | 40% | 3526 | 60% |
| 43% | 5715 | 125 | 2189 | 38% | 3526 | 62% |
| 47% | 5277 | 100 | 1751 | 33% | 3526 | 67% |
| 52% | 4839 | 75 | 1313 | 27% | 3526 | 73% |
| 53% | 4717 | 68 | 1191 | 25% | 3526 | 75% |
| 56% | 4401 | 50 | 876 | 20% | 3526 | 80% |
| 60% | 3964 | 25 | 438 | 11% | 3526 | 89% |
| 63% | 3701 | 10 | 175 | 5% | 3526 | 95% |
| 64% | 3613 | 5 | 88 | 2% | 3526 | 98% |
| 65% | 3526 | 0 | 0 | 0% | 3526 | 100% |

Further, and as above, in one embodiment, the pressure generating assembly 510 is not used and the mechanical bias assembly 550 generates a total force of about 3,526 lbf.

Figure 18:
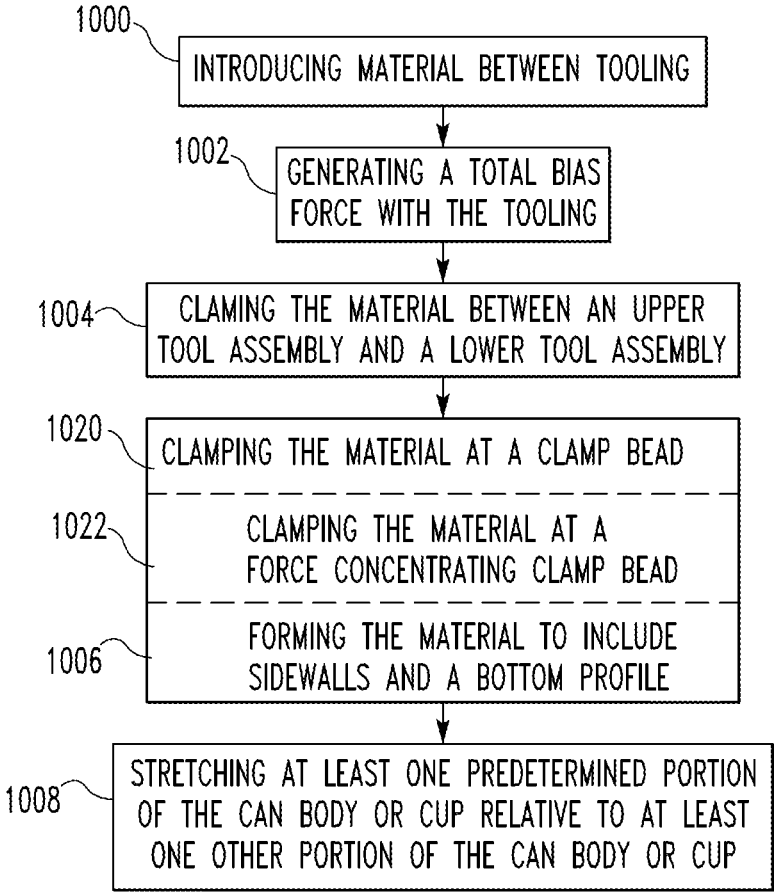
FIG. 18 is a flowchart showing a disclosed method.

Accordingly, as shown in FIG. 18, use of the tooling 400, 400A described above includes introducing 1000 material, i.e., a can body 2 or cup 22, 122, 422 between tooling 400, 400A, generating 1002 a total bias force within the tooling 400, 400A, clamping 1004 the material between an upper tool assembly 402, 402A and a lower tool assembly 406, 406A, forming 1006 the material to include sidewalls 4, 6 and a bottom profile 8, and, wherein, in an exemplary embodiment, the bottom profile 8 includes a dome portion 12 and an annular ridge 10, and selectively stretching 1008 at least one predetermined portion of the can body 2 or cup 22, 122, 422 relative to at least one other portion of the can body 2 or cup 22, 122, 422 to provide a corresponding thinned portion of the shell. Further, clamping 1004 the material between an upper tool assembly 402, 402A and a lower tool assembly 406, 406A includes clamping 1020 the material at a clamp bead 410, and/or, clamping 1022 the material at a progressive clamp bead 600.

Returning to FIG. 19A, in an exemplary embodiment, a tooling 400A that includes a progressive clamp bead 600 allows for reduced forces as shown. This further resulted in reduced counter loads and solves the problems stated above. In an exemplary embodiment, forming a cup with a dome 430, and in this example a standard 0211×413 cup (3.5 inch-3.625 inch diameter cup for a standard 12.0 oz. beverage can), made from steel, without a clamp bead 600 requires a force of about 15,940 lbs. (per cup) which includes 9,205 lbs. of force generated by air pressure and 6,735 lbs. of spring force. In an exemplary embodiment, wherein the tooling 400A that includes a progressive clamp bead 600, forming a cup with a stretched dome 430 made from steel requires a force of about 9,034 lbs. (per cup) which includes 2,299, lbs. of force generated by air pressure and 6,735 lbs. of spring force. In another exemplary embodiment, forming a cup made from steel requires a force of about 6,735 lbs. (per cup) which includes 0 lbs. of air pressure and 6,735 lbs of spring force.

Returning to FIG. 19B, in an exemplary embodiment, a tooling 400A that includes a progressive clamp bead 600 allows for reduced forces as shown. This further resulted in reduced counter loads and solves the problems stated above. In an exemplary embodiment, forming a cup with a dome 430, and in this example a standard 0211×413 cup (3.5 inch-3.625 inch diameter cup for a standard 12.0 oz. beverage can), made from aluminum, without a clamp bead 600 requires a force of about 9,916 lbs. (per cup) which includes 6,390 lbs. of force generated by air pressure and 3,526 lbs. of spring force. In an exemplary embodiment, wherein the tooling 400A that includes a progressive clamp bead 600, forming a cup with a stretched dome 430 made from aluminum requires a force of about 4,750 lbs. (per cup) which includes 1,224, lbs. of force generated by air pressure and 3,526 lbs. of spring force. In another exemplary embodiment, forming a cup made from aluminum requires a force of about 3,526 lbs. (per cup) which includes 0 lbs. of air pressure and 3,526 lbs of spring force.

Thus, a method of forming a 2011 steel cup 422 includes providing 1100 a tooling 400A that includes a progressive clamp bead 600, applying a total pressure that is between about 4% to 60%, less than the pressure required by a tooling that does not include a progressive clamp bead 600. Further, a method of forming a 2011 aluminum cup 422 includes providing 1100 a tooling 400A that includes a progressive clamp bead 600, applying a total pressure that is between about 1% to 65%, less than the pressure required by a tooling that does not include a progressive clamp bead 600. It is again noted that the reduction in forming pressure solves the problems stated above.

Stated alternately, a method of forming a cup 422 including a clamp bead 420 or a progressive clamp bead 600 includes the following. Initially, it is noted that the tooling 400, 400A is driven by a drive assembly having a reciprocating arm or ram, or similar construct, coupled to a rotating crank, none shown. The rotating crank moves 360 degrees during a cycle. Thus, the application of loads and the movement of the elements of the tooling 400, 400A are related to the angular position of the crank. For the purpose of this disclosure, it is understood that, as described below, the identified angles represent the ram, or similar construct, angle relative to the crank during its rotation; this angle is, as employed herein, the "position of stroke." Further, this position is associated with the position of the outer slide. That is, as employed herein, the "position of stroke" is the radial position of the crank and is measured herein by degrees wherein zero degrees represents the bottom dead center for the punch 404A on a dual action press. It is further understood that the angles are relative. That is, for example, by altering the configuration of the drive assembly and/or the tooling 400, 400A, the identified steps could occur at similar relative angles, e.g., the initiation, change, duration, and reduction of loads could occur 10 degrees sooner than the angles identified below. The relevant disclosure is that of the value, change, and duration of the identified load(s) as opposed to a specific angle at which the value, change, and duration of the identified load(s) occurs. Further, via the use of cams, or similar constructs (not shown), the punch 404A moves at a different time than the outer slide. The "position of stroke" is identified in relation to the outer slide.

As noted above, FIGS. 19A and 19B show the forces associated with the formation of a cup wherein the tooling does not include a progressive clamp bead 600. Line 700 represents the load over crank angle of a prior art tooling without a clamp bead 410 and/or progressive clamp bead 600. Line 702 represents the load over time of tooling 400A with a progressive clamp bead 600, as well as an outer slide with a pressure concentrating forming surface (not shown), as disclosed in U.S. patent application Ser. No. 14/722,187. The horizontal axis shows the crank angle as discussed above. The right vertical axis represents the load for each "pocket" as defined above. The specific loads are exemplary and represent the formation of DAC-150 cups in an eight-out (eight cups formed at one time) press. These specific loads are exemplary; it is understood that different model cups would have different specific loads. The relative, i.e., percentage, reduction in loads solves the problems stated above.

Initially, there is a bottom of inner stroke phase (wherein the material is blanked) for the outer slide when the position of stroke is between about 145° and about 150°. For a steel cup, and as shown on FIG. 19A, with prior art tooling, the force during blanking peaks at above 12,000 lbf, or about 12,367 lbf. (see Appendix 1) compared to the tooling 400A, such as an outer slide with a pressure concentrating forming surface (not shown), which has an peak blanking force of about 10,000 lbf. or about 9,589 lbf. By the end of the bottom of inner stroke phase, the prior art tooling allowed the force to be lessened to between 5,000 lbf and 6,000 lbf. and, in an exemplary embodiment, to about 5,250 lbf. Thus, when utilizing the tooling 400A with an outer slide with a pressure concentrating forming surface, the force is reduced; that is, the force is lessened to between 2,000 lbf and 3,000 lbf. or about 2,625 lbf. As used herein, "applying a reduced impact force" means that tooling including an outer slide with a pressure concentrating forming surface applies a reduced force, or a moderately reduced force, relative to the prior art tooling during the impact phase. Further, "applying a reduced impact force" includes "applying a reduced clamp bead impact force" which, as used herein, is the reduced force associated with a tooling 400 including a clamp bead 410. Further, "applying a reduced impact force" includes "applying a reduced progressive clamp bead impact force" which, as used herein, is the reduced force associated with a tooling 400 including a progressive clamp bead 600. Further, "applying a reduced impact force," "applying a reduced clamp bead impact force," or "applying a reduced progressive clamp bead impact force" solves the problems stated above.

After the bottom of inner stroke phase, the draw pad bias phase occurs when the position of stroke is between about 150° and about 180°. During the draw pad bias phase, the outer elements of the upper tool assembly 402A engage the material. During the draw pad bias phase, the force (hereinafter the "draw pad bias force") remains substantially constant. With prior art tooling, the draw pad bias force was about 5,250 lbf. compared to the tooling 400A with a an outer slide with a pressure concentrating forming surface which has a draw pad bias force of about 2,625 lbf. As used herein, "applying a reduced draw pad bias force" means that tooling, including an outer slide with a pressure concentrating forming surface, applies a reduced force, or a moderately reduced force, relative to the prior art tooling during the draw pad bias phase. Further, "applying a reduced draw pad bias force" includes "applying a reduced clamp bead draw pad bias force" which, as used herein, is the reduced force associated with a tooling 400 including a clamp bead 410.

Further, "applying a reduced draw pad bias force" includes "applying a reduced progressive clamp bead draw pad bias force" which, as used herein, is the reduced force associated with a tooling 400 including a progressive clamp bead 600. Further, "applying a reduced draw pad bias force," "applying a reduced clamp bead draw pad bias force," or "applying a reduced progressive clamp bead draw pad bias force" solves the problems stated above.

After the draw pad bias phase, the draw phase occurs when the position of stroke is between about 180° and about 200°. During the draw phase, the inner elements of the upper tool assembly 402A engage the material and form the cup, as described above. Further, during the draw phase, the force (hereinafter the "draw force") initially increases then remains substantially constant. With prior art tooling, the draw force increased from about 5,250 lbf to about 6252 lbf. It is noted that for tooling 400A with a clamp bead 410 and/or progressive clamp bead 600, the draw forces are substantially similar, i.e., about 6252 lbf. As used herein, "applying a draw force" means that tooling, including a clamp bead 410 and/or progressive clamp bead 600, applies a similar force relative to the prior art tooling during the draw phase.

After the draw phase, the motion phase occurs when the position of stroke is between about 200° and about 245°. During the motion phase, the partially formed cup is moved toward the contour 316. During the motion phase, the forces on the prior art tooling and the tooling 400, 400A with a clamp bead 410 and/or progressive clamp bead 600 are substantially similar and are, essentially, reduced to zero as the cup moves.

After the motion phase, the pre-doming phase occurs when the position of stroke is between about 245° and about 250°. During the pre-doming phase, the force (hereinafter the "pre-doming force") increases quickly. That is, the pre-doming phase is a second impact wherein the cup engages the contour 316. With prior art tooling, the pre-doming force increased from about 0 (zero) to about 10,242 lbf. compared to the tooling 400A with a clamp bead 410 and/or progressive clamp bead 600 wherein the pre-doming force increases from about 0 (zero) to about 3,336 lbf. As used herein, "applying a reduced pre-doming force" means that tooling, including a clamp bead 410 and/or progressive clamp bead 600, applies a reduced force, or a moderately reduced force, relative to the prior art tooling during the pre-doming phase. Further, "applying a reduced pre-doming force" includes "applying a reduced clamp bead pre-doming force," or "applying a moderately reduced clamp bead pre-doming force" which, as used herein, is the reduced force, or a moderately reduced force, associated with a tooling 400 including a clamp bead 410. Further, "applying a reduced pre-doming force," or "applying a moderately reduced pre-doming force" includes "applying a reduced progressive clamp bead pre-doming force" which, as used herein, is the reduced force, or a moderately reduced force, associated with a tooling 400 including a progressive clamp bead 600. Further, "applying a reduced pre-doming force," or "applying a reduced clamp bead pre-doming force" or "applying a reduced progressive clamp bead pre-doming force" solves the problems stated above.

After the pre-doming phase, the doming phase occurs when the position of stroke is between about 250° and about 280°. During the doming phase, the dome is formed, as described above. Further, during the doming phase, the force (hereinafter the "doming force") increases while the rate of increase in the doming force decreases. When the position of stroke is about 280°, the rate of increasing force levels off and the force begins to decrease in the release phase, discussed below. It is noted that when the position of stroke is between about 245° and about 265°, when the force is between about 667 lbf. and 7,572 lbf. the material is "progressively clamped" as defined above. That is, in the identified range of the position of stroke and the identified range of forces, and when the tooling 400 includes a progressive clamp bead 600, the material initially flows through the "progressively clamped" area. At about position of stroke 266 and at about a force of 7,760 lbf. the amount of material that moves/flows through the progressively clamped area decreases until the amount is negligible.

With prior art tooling, the doming force increased from about 8,194 lbf. to about 15,940 lbf. (as discussed above). The tooling 400, 400A with a clamp bead 410 and/or progressive clamp bead 600 forms the dome 430 using a reduced force wherein the doming force increased from of about 2,669 lbf. to about 9,034 lbf. (as discussed above). As used herein, "applying a reduced doming force" means that tooling, including a clamp bead 410 and/or progressive clamp bead 600, applies a reduced force relative to the prior art tooling during the doming phase. Further, "applying a reduced doming force" includes "applying a reduced clamp bead doming force" which, as used herein, is the reduced force associated with a tooling 400 including a clamp bead 410. Further, "applying a reduced doming force" includes "applying a reduced progressive clamp bead doming force" which, as used herein, is the reduced force associated with a tooling 400 including a progressive clamp bead 600. Further, "applying a reduced doming force," or "applying a reduced clamp bead doming force" or "applying a reduced progressive clamp bead doming force" solves the problems stated above.

Further, as used herein, "applying a moderately reduced doming force" means that tooling, including a clamp bead 410 and/or progressive clamp bead 600, applies a moderately reduced force relative to the prior art tooling during the doming phase. Further, "applying a moderately reduced doming force" includes "applying a moderately reduced clamp bead doming force" which, as used herein, is the moderately reduced force associated with a tooling 400 including a clamp bead 410. Further, "applying a moderately reduced doming force" includes "applying a moderately reduced progressive clamp bead doming force" which, as used herein, is the moderately reduced force associated with a tooling 400 including a progressive clamp bead 600. Further, "applying a moderately reduced doming force," or "applying a moderately reduced clamp bead doming force" or "applying a moderately reduced progressive clamp bead doming force" solves the problems stated above.

After the doming phase, a release phase occurs when the position of stroke is between about 280° and about 310°. During the release the forces decrease in a manner that is substantially the opposite of the rate that the forces increased during the doming phase and the pre-doming phase. That is, the forces decrease while increasing the rate of the decrease. When the upper tool assembly 402, 402A and the lower tool assembly 406, 406A separate, the force is rapidly reduced to zero.

Thus, the method includes, introducing material between tooling 1000, as detailed above, applying a reduced impact force 2002, applying a reduced draw pad bias force 2004, applying a draw force 2006, reducing the force during a motion phase 2007, applying a reduced pre-doming force 2008, and applying a reduced doming force 2010. Further, as noted above, applying a reduced impact force 2002 includes one of applying a reduced clamp bead impact force 2022, or, applying a reduced progressive clamp bead impact force 2032. Similarly, applying a reduced draw pad bias force 2004 includes one of applying a reduced clamp bead draw pad bias force 2024 or applying a reduced progressive clamp bead draw pad bias force 2034. Similarly, applying a reduced pre-doming force 2008 includes one of applying a reduced clamp bead pre-doming force 2028 or applying a reduced progressive clamp bead pre-doming force 2038. Similarly, applying a reduced doming force 2010 includes one of applying a reduced clamp bead doming force 2040 or applying a reduced progressive clamp bead doming force 2050. Further, the disclosed method includes applying a moderately reduced doming force 2011. Applying a moderately reduced doming force 2011 includes one of applying a moderately reduced clamp bead doming force 2041 or applying a moderately reduced progressive clamp bead doming force 2051.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. Tooling for selectively forming a blank of material into a container, the container including a first sidewall, a second sidewall, and a bottom portion extending between the first sidewall and the second sidewall, the tooling comprising:

an upper tool assembly;

a lower tool assembly;

the upper tool assembly and the lower tool assembly include a number of clamp beads;

wherein the blank of material is clamped between the upper tool assembly and the lower tool assembly at each clamp bead; and wherein the upper tool assembly and the lower tool assembly are structured to stretch the bottom portion which is thereby thinned relative to the first sidewall and the second sidewall to form a thinned preselected profile.

2. The tooling of claim 1 wherein:

the upper tool assembly includes a forming punch;

said forming punch includes a number of clamp bead recesses;

wherein the lower tool assembly includes a pad;

said pad includes a number of clamp bead projections; and wherein the forming punch moves the blank of material into contact with the pad.

3. The tooling of claim 2 wherein said number of clamp bead recesses and said number of clamp bead projections are structured to clamp the blank of material between the upper tool assembly and the lower tool assembly.

4. The tooling of claim 1 wherein said lower tooling assembly includes a selectable hybrid bias generating assembly.

5. The tooling of claim 4 wherein the selectable hybrid bias generating assembly includes a pressure generating assembly and a mechanical bias assembly.

6. The tooling of claim 5 wherein the number of clamp beads are a number of progressive clamp beads.

7. The tooling of claim 6 wherein:

the upper tool assembly includes a forming punch;

said forming punch includes a number of clamp bead recesses;

wherein the lower tool assembly includes a pad and a riser assembly;

said riser assembly having a pressure surface;

said pad includes a number of clamp bead projections; and said riser assembly operatively coupled to said lower tool assembly pad.

8. The tooling of claim 7 wherein:

said lower tool assembly includes a hybrid bias generating assembly; and the hybrid bias generating assembly operatively coupled to said lower tool assembly riser assembly.

9. The tooling of claim 8 wherein the hybrid bias generating assembly includes a pressure generating assembly, a mechanical bias assembly, and a number of hybrid components.

10. The tooling of claim 8 wherein the hybrid bias generating assembly is an active hybrid bias generating assembly.

11. The tooling of claim 8 wherein:

the lower tool assembly includes a pressure chamber;

the pressure generating assembly is structured to pressurize the pressure chamber; and the mechanical bias assembly includes a number of springs.

12. The tooling of claim 1 wherein the number of clamp beads are a number of progressive clamp beads.

13. The tooling of claim 12 wherein:

the upper tool assembly includes a forming punch;

said forming punch includes a number of clamp bead recesses;

wherein the lower tool assembly includes a pad and a riser assembly;

said riser assembly having a pressure surface;

said pad includes a number of clamp bead projections; and said riser assembly operatively coupled to said lower tool assembly pad.

14. The tooling of claim 1 wherein:

the lower tool assembly further includes a contour; and wherein the contour engages and stretches the bottom portion to form the thinned preselected profile.

15. The tooling of claim 14 wherein said contour is a dome.

16. The tooling of claim 10 wherein the upper tool assembly and the lower tool assembly are structured to stretch the blank of material at or about a dome so as to have a substantially uniform thickness.

* * * * *